US009650115B2

(12) United States Patent
Coleman

(10) Patent No.: US 9,650,115 B2
(45) Date of Patent: May 16, 2017

(54) ADJUSTABLE CARRY BAG

(71) Applicant: Anthony Coleman, Amityville, NY (US)

(72) Inventor: Anthony Coleman, Amityville, NY (US)

( * ) Notice: Subject to any disclaimer, the term of this patent is extended or adjusted under 35 U.S.C. 154(b) by 165 days.

(21) Appl. No.: 14/492,025

(22) Filed: Sep. 21, 2014

(65) Prior Publication Data

US 2016/0083055 A1 Mar. 24, 2016

(51) Int. Cl.

*B63B 35/79* (2006.01)
*A45C 7/00* (2006.01)
*A45F 3/02* (2006.01)

(52) U.S. Cl.

CPC ..... *B63B 35/7946* (2013.01); *A45C 7/0022* (2013.01); *A45F 3/02* (2013.01); *A45F 2200/05* (2013.01)

(58) Field of Classification Search

CPC ... B63B 35/7946; B65D 15/02; A45C 7/0022; A45F 3/02; A45F 2200/05
USPC ..... 220/4.21, 4.27, 4.24; 206/315.1
See application file for complete search history.

(56) References Cited

U.S. PATENT DOCUMENTS 3,443,671 A * 5/1969 Dyke ..... A45C 7/0027 190/103
3,921,871 A * 11/1975 Heil ..... A63C 11/027 220/8
4,643,302 A * 2/1987 Baumgardner ..... A45C 3/00 190/105
4,715,416 A * 12/1987 Horne ..... B63B 35/85 190/104
5,094,344 A * 3/1992 Savage ..... B63B 35/7946 206/315.1
6,311,883 B1 * 11/2001 Greenberg ..... A63C 11/025 206/315.1
6,450,333 B1 * 9/2002 McClenahan ..... A01K 97/08 190/104
6,585,137 B1 * 7/2003 Archuleta ..... A45C 3/00 224/576
7,121,401 B1 * 10/2006 Sinha ..... F42B 39/02 206/3

(Continued)

*Primary Examiner* — Anthony Stashick
*Assistant Examiner* — James Way
(74) *Attorney, Agent, or Firm* — DP IP Group; Franco S. De Liguori

(57) ABSTRACT

An adjustable carry bag has two end sections for releasable connection together at connecting ends thereof to form an interior space for accommodating therein at least one sport board. Each end section has a first access opening providing access into the interior space and a closed perimeter portion at the connecting end defining a second access opening providing access into the interior space different from the first access opening. In an open state, the first access opening provide access into the interior space for accommodating therein a sport board. In a closed state of the first access opening when the end sections are connected together, the bag completely encloses and securely holds therein the sport board. A coupling structure extends from the closed perimeter portion of each end section for releasably coupling the end sections together so that the closed perimeter portions and the coupling structures of the end sections encircle a preselected region of the interior space of the bag in both the open and closed states of the first access opening.

16 Claims, 16 Drawing Sheets

(56) References Cited

U.S. PATENT DOCUMENTS

| | | | | |
|---|---|---|---|---|
| 2001/0037923 | A1* | 11/2001 | Godshaw | A45C 13/02 190/110 |
| 2006/0016842 | A1* | 1/2006 | Lu | A45C 13/021 224/600 |
| 2006/0289584 | A1* | 12/2006 | Lu | A45C 7/009 224/605 |
| 2007/0054574 | A1* | 3/2007 | Peach | A45F 3/04 441/68 |
| 2010/0006469 | A1* | 1/2010 | Allouche | B63B 35/7946 206/523 |
| 2012/0255879 | A1* | 10/2012 | Gillespie | A63B 71/0036 206/216 |
| 2014/0175092 | A1* | 6/2014 | Boyles | A01K 97/08 220/8 |
| 2014/0305364 | A1* | 10/2014 | Alphin | B63B 35/7946 114/363 |

* cited by examiner

ADJUSTABLE CARRY BAG

BACKGROUND OF THE INVENTION

Technical Field

The present invention relates generally to carry bags and, more specifically, to a carry bag that is adjustable in a length direction thereof to enable it to securely carry one or more sport boards. The adjustable carry bag of the present invention is particularly adapted for carrying one or more surfboards of different sizes therein during transport in such a manner so as to protect the surfboard(s) from damage due to shock, impact, and mishandling during shipment.

Background Information

Surfing has become a very popular international sport. In a 2002 survey, Boardtrac, a surf industry group, estimated the United States surfing population to be 2.4 million people, while a recreational survey completed by the National Oceanic and Atmospheric Administration (NOAA) in the year 2000 estimated the United States Surfing population to be 3.3 million. Worldwide estimates of surfing participants vary from 5 million, as estimated by the Surf Industry Manufacturer's Association, to 23 million participants, as estimated by the International Surfing Association. An international magazine, the Economist, published an article in 2012 estimating that "the number of surfers worldwide increased from 26 to 35 million between 2001 and 2011."

The number of surfers that own a surfboard is on the increase. Many surfers travel domestically and internationally for unique locations to surf. The surfing equipment used by surfers may vary according to the surfer's ability, surfing style, budget, and the potential surfing location wave types. The surfboard ownership population may be divided into two groups: those with shorter surfboards ("short boarders") and those with longer surfboards ("long boarders"), as is known in the sport. Short boarders may typically utilize surfboards that are from 5'8" to 6'10" in length. Long boarders may typically utilize surfboards that are from 8' to 9'6" in length. A group of surfers who utilize surfboard lengths that are in between the long boarders and short boarders are typically noted as "fun boarders," as is known in the art. The fun boarders may utilize boards from 7' to 7'10" in length.

Surfboards are light and buoyant. The low density material and finish tend to be delicate, and may easily sustain damage due to an impact or scratch. Typical surfboard construction comprises a foam core which may be laminated with one or two layers of fiberglass or similar material. The layers of fiberglass are typically then coated with resin or similar hydrophobic material that, when hardened, forms a thin waterproof shell, resulting in a board that is buoyant. If a typical surfboard obtains some damage during transport or other damage wherein the shell becomes cracked or punctured, the performance of the surfboard would then become compromised.

For any surfer, the purchase of a surfboard is an investment worth protecting. Beyond that, surfboards can be cumbersome to transport when they are not in use on water, and many surfers want a way to both protect and carry their surfboard when they travel, whether it is back and forth to the beach, or on a plane to the next hot surfing destination.

Transporting surfboards via airplane and other travel methods requires the use of a protective covering that can be used to also conveniently transport the surfboards. Airlines typically charge a fee of $100 or more, one way, to transport a surfboard bag or container as luggage. Surfers travel to varying destinations, and as such, may travel with multiple surfboards of varying lengths. Furthermore, multiple people travelling together may often put more than one surfboard in a carry bag to save money. A surfboard owner or owners with multiple boards of varying lengths do not have cost effective options for transporting surfboards. Either multiple carry bags of varying lengths must be purchased, or a surfboard carry bag that is the longest that a particular surfer or surfers would ever use must be purchased in order to accommodate surfboards of varying lengths. The latter option is inconvenient because if the carry bag is too long, the functional and protective nature of the carry bag may be compromised. Furthermore, some existing carry bags in the marketplace allow for only minimal adjustability of approximately 1 foot, which is also not desirable when a surfboard owner has multiple boards where the range of lengths is greater than 1 foot.

Therefore, there is a need for an adjustable carry bag that is capable of accommodating multiple surfboards of multiple lengths, that provides sufficient protection for the surfboards, that is cost effective, and that is easy to carry.

SUMMARY OF THE INVENTION

It is an object of the present invention to provide an adjustable carry bag configured to contain at least one surfboard during transport so as to effectively protect the surfboard from impact, shock, and scratches which would ordinarily result in substantial damage to the surfboard.

It is another object of the present invention to provide an adjustable carry bag that is adjustable in the length direction thereof to accommodate one or multiple boards of various sizes securely and in a compact manner.

It is yet another object of the present invention to provide an adjustable carry bag that may be lengthened or shortened by coupling or removing one or more extension sections between a pair of end sections.

It is still another object of the present invention to provide an adjustable carry bag which is cost effective and easy to use and carry.

The foregoing and other objects of the present invention are carried out by an adjustable carry bag for carrying at least one sport board. In one exemplary embodiment, a pair of end sections are configured for releasable connection together at connecting ends thereof to form an interior space of the adjustable carry bag for accommodating therein at least one sport board. Each of the end sections has a first access opening providing access into the interior space and a closed perimeter portion at the connecting end thereof defining a second access opening providing access into the interior space different from the access provided by the first access opening. The first access opening is configured in an open state thereof to provide access into the interior space for accommodating therein the least one sport board and is configured in a closed state thereof so that the bag completely encloses and securely holds therein the at least one sport board when the end sections are releasably connected together. A coupling structure extends from the closed perimeter portion of each of the end sections for releasably coupling the end sections together so that the second access openings are generally aligned with one another and the closed perimeter portions and the coupling structures of the end sections encircle a preselected region of the interior space of the adjustable carry bag in both the open and closed states of the first access opening.

In another exemplary embodiment, at least one extension section is configured for releasable connection between the connecting ends of the end sections to increase the length of the adjustable carry bag. The at least one extension section has at opposite ends thereof respective closed perimeter portions defining an opening and having coupling structures extending from the respective closed perimeter portions. The coupling structures of the at least one extension section is configured for releasable connection to the coupling structures of the end sections to releasably couple together the end sections and the at least one extension section to increase the length of the adjustable carry bag with the opening of the at least one extension section being disposed in substantial alignment with the second access openings of the end sections.

The summary is neither intended nor should it be construed as being representative of the full extent and scope of the present disclosure, which these and additional aspects will become more readily apparent from the detailed description, particularly when taken together with the appended drawings.

BRIEF DESCRIPTION OF THE DRAWINGS

The foregoing summary, as well as the following detailed description of the preferred embodiments of the invention, will be better understood when read in conjunction with the accompanying drawings. For the purpose of illustrating the invention, there is shown in the drawings embodiments which are presently preferred. It should be understood, however, that the invention is not limited to the precise arrangement and instrumentalities shown. In the drawings.

DETAILED DESCRIPTION OF THE INVENTION

Figure 1:
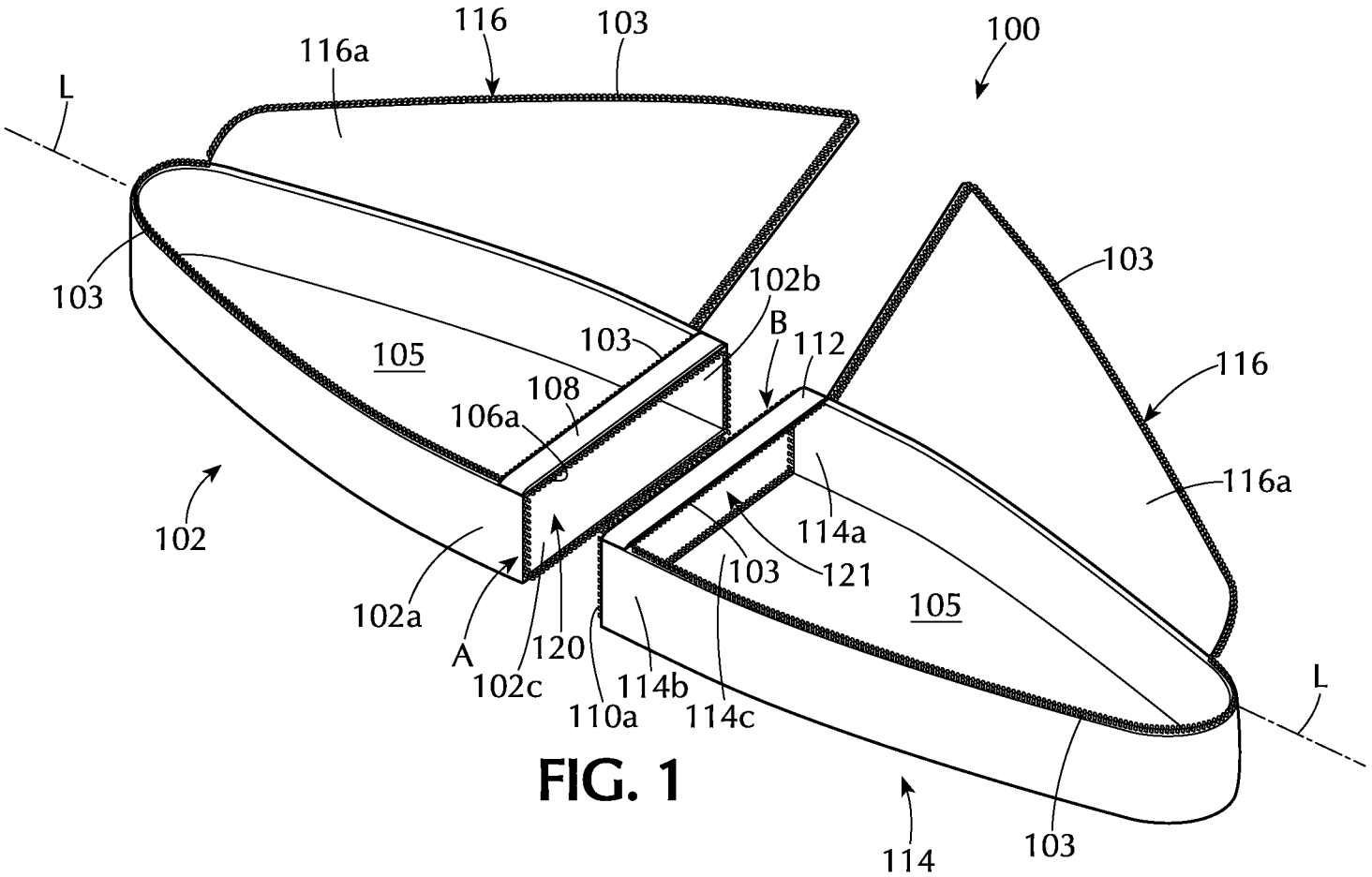
FIG. 1 is an exploded perspective view of an exemplary embodiment of an adjustable carry bag according to the present invention, the adjustable carry bag being shown with the end sections in an uncoupled state and with closure flaps shown in an open position.

The word "exemplary" is used herein to mean "serving as an example, instance, or illustration." Any embodiment described herein as "exemplary" is not necessarily to be construed as preferred or advantageous over other embodiments. The images in the drawings are simplified for illustrative purposes and are not depicted to scale. To facilitate understanding, identical reference numerals have been used, where possible, to designate identical elements that are common to the figures, except that suffixes may be added, when appropriate, to differentiate such elements.

The detailed description set forth below in connection with the appended drawings is intended as a description of exemplary embodiments of the present invention and is not intended to represent the only embodiments in which the present invention can be practiced. The detailed description includes specific details for the purpose of providing a thorough understanding of the exemplary embodiments of the invention. It will be apparent to those skilled in the art that the exemplary embodiments of the invention may be practiced without these specific details. The term "surfboard" in the present invention may also apply to other sports wherein transporting of large, flat items is difficult or there is a need. Some alternative examples may be sail boarding or paddle boarding.

There are many types of existing surfboard bags on the market. As of April 2014, retail pricing for surfboard bags that provide good protection, and have multiple surfboard capacity cost from $200 to $500 USD. The most practical type of commercial bag is the coffin bag, so named due to the shape and utility resemblance to that of a coffin. Coffin bags typically have a lid that encompasses the entire top surface of the bag which is then sealed together with a zipper. Coffin bags are popular because they tend to be among the lower priced bags, while being able to hold at least 3 and up to 5 surfboards in some circumstances. Coffin surfboard bags offer sufficient surfboard protection through utilization of high density foam padding in the bag walls. Furthermore, the utility of a coffin style bag is that it allows for complete board access prior to sealing the bag, enabling the user to selectively add padding to vulnerable areas. Many coffin bags also have additional enclosure volume for additional items. One major drawback to coffin bags is that they are not adjustable or have very limited adjustability.

Additional forms of commercially available surfboard bag are: the tail entry, side entry, and mid entry surfboard bags. A side entry surfboard bag is similar to a coffin style bag, wherein the side entry bag usually offers less interior bag volume and decreased access to the interior of the bag prior to sealing due to limited access through a zippered flap along the side of the bag. Mid entry surfboard bags typically have openings near the mid-line of the bag in order to slide the surfboard in. Tail entry surfboard bags typically have a zippered opening on a distal end of the surfboard bag, allowing board entry, as is known in the art.

Additional variations of commercially available bags include the aforementioned designs but with some or all of the protective component. One example is the hard case, which is comprised simply of two separated plastic halves which encompass the surfboard. In another variant, one half of the surfboard bag is a hard plastic while the other half of the surfboard bag is a flexible material. Due to the nature of hard plastics, the surfboard bags based upon hard plastics are much heavier than their flexible material counterparts. Hard plastic based bags provide the best protection and usually offer additional volume for accommodating multiple boards. These hard case designs are generally limited in how much they can adjust their length, and have limited or no flexibility in width and height, and the fasteners utilized to assemble the bags tend to be metal clasps and rivets, which are bulky. Hard case bags are difficult to transport and store because they are inflexible. Hard case bags generally exhibit the most expensive retail price among surfboard bags.

The present invention discloses an adjustable carry bag for sport boards that overcomes the foregoing drawbacks of prior art carry bags.

Although the exemplary embodiments disclosed herein are illustrated and described as an adjustable carry bag for carrying surfboards, it is noted that this is done purely for illustrative purposes, and the adjustable carry bag may be used to carry any object, including sport boards of types other than surfboards, a few suitable examples being kite surfing boards, windsurfing boards, sail boards, etc.

For convenience of description, the terms "upper," "lower," "top," "bottom," "right," "left," "side," "edge" and words of similar import will have reference to the various members and components of the adjustable carry bag of the present invention as arranged and illustrated in the figures of the drawings and described hereinafter in detail. As used herein, the term "substantially" means to a considerable, large, and/or great, but not necessarily whole and/or entire, extent and/or degree. The term "about," and the use of ranges in general whether or not qualified by the term "about," means that the number comprehended is not limited to the exact number set forth herein, and is intended to refer to ranges substantially within the quoted range not departing from the scope of the invention.

Additionally, embodiments in the detailed description will be described with various views as ideal exemplary views of the inventive concept. Accordingly, shapes and configurations of the exemplary views may be modified according to manufacturing techniques and/or allowable errors. Therefore, the embodiments of the inventive concept are not limited to the specific ranges and configurations illustrated in the exemplary views, but may include other shapes and configurations that may be created according to manufacturing processes.

FIGS. 1, 2, 3A-3C and 4A-4B show an adjustable carry bag ("bag"), generally designated at 100, in accordance with an exemplary embodiment of the present invention. Generally described, bag 100 includes an elongate enclosure or housing adapted to completely enclose and securely hold one or more surfboards and/or accessories therein. As further described below with reference to FIGS. 5-8, bag 100 is adjustable in length such that an interior volume of the enclosure can be selectively increased or decreased in a length direction L in order to accommodate and securely store individual boards of different sizes, a varying number of boards, and a varying number of accessories. To accomplish the change in length L, bag 100 employs one or more removable intermediate sections (extension sections) as further described below.

Figure 2:
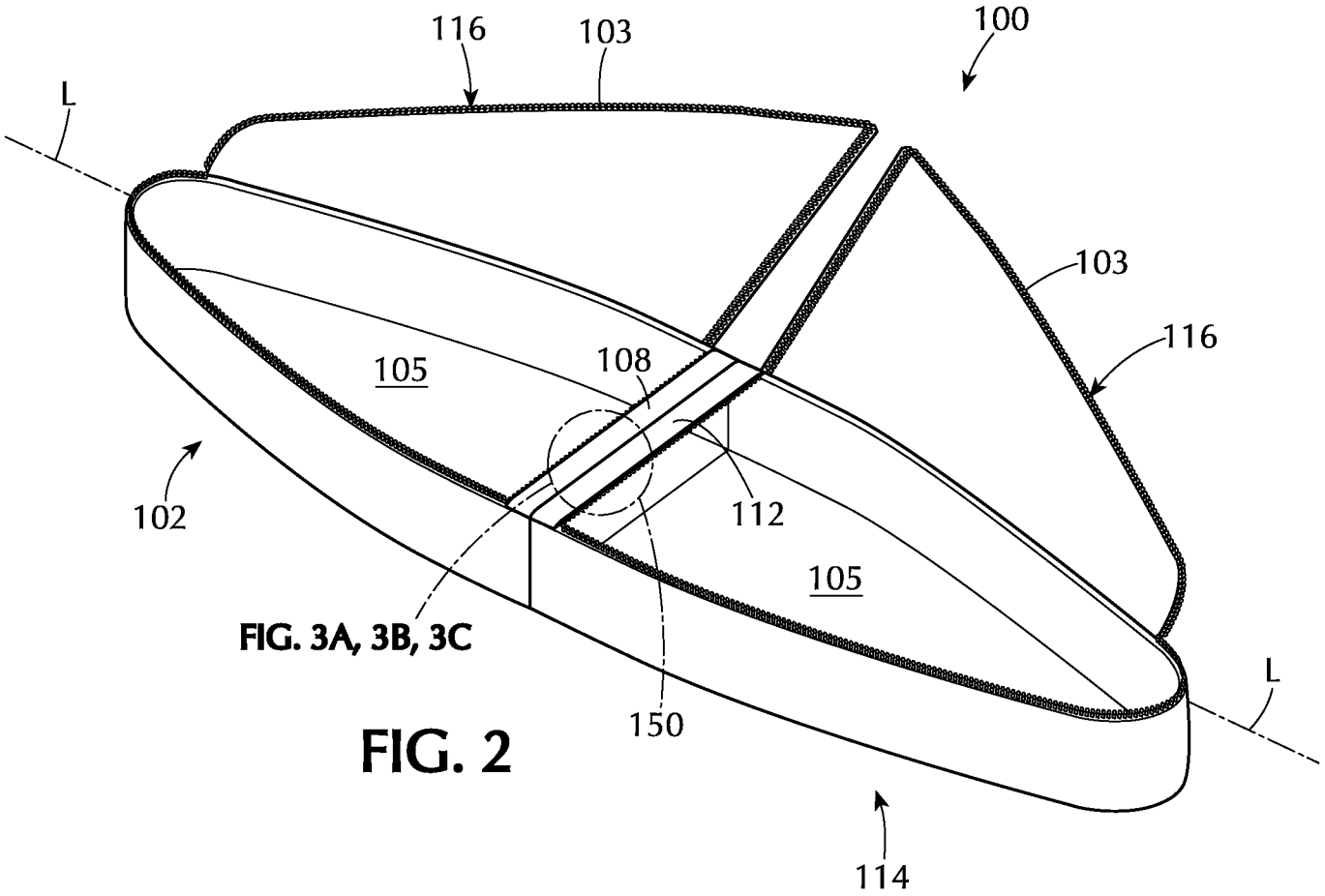
FIG. 2 shows the adjustable carry bag of FIG. 1 with the ends sections coupled together in a manner according to the present invention.

FIG. 1 is an exploded perspective view of bag 100. In the simplest form, bag 100 comprises two separate and independent mating end sections, generally designated at 102, 114, which are configured to be releasably connected to one another so as to be securely coupled together as further described below. When coupled together, end sections 102, 114 form an interior space of bag 100 for accommodating therein at least one sport board (e.g., surfboard). In this exemplary embodiment each of end sections 102, 114 has a length extending in the length direction L of bag 100. End sections 102, 114 form two uniform halves which are identical in construction and of equal size and dimensions, and correspond to nose/tail sections of bag 100 in a fully assembled/coupled state. End section 102 has a proximal end (right side of 102 in FIG. 1) and a distal end (left side of 102 in FIG. 1). Likewise, end section 114 has a proximal end (left side of 114 in FIG. 1) and a distal end (right side of 114 in FIG. 1). Thus for each end section 102, 114, the proximal end is the end on the opposite side of the distal (other) end with respect to the length direction L and corresponds to the connecting end of each section. Each end section has a width which, in the exemplary embodiment shown in FIGS. 1-2, is a dimension along a direction of the end section that extends generally perpendicular to length direction L. The width of each end section gradually decreases from the proximal end to the distal end thereof. End sections 102, 114, which are shown in an uncoupled state in FIG. 1, are formed with respective portions (panels), including lower or bottom portions 102*c*, 114*c* and side portions 102*a*, 102*b* and 114*a*, 114*b*, extending from bottom portions 102*c*, 114*c* and forming respective top openings providing access (first access openings) into pockets 105 each corresponding to a portion of the interior space of bag 100.

Each pocket 105 defines an interior volume large enough to accommodate at least a portion of one or more surfboards S (e.g., of identical or different size) in a manner shown in FIG. 6, for example, which illustrates another exemplary embodiment of the adjustable carry bag according to the present invention further described below. The first access opening of each end section 102, 114 is the primary means via which the one or more surfboards and accessories are inserted into and arranged in (as well as removed from) the interior space of bag 100 when end sections 102, 114 are coupled together. It will be appreciated that while end sections 102, 114 are depicted in the figures as being identical in construction and of equal size and dimensions, certain modifications can be made to the end sections such that they are only generally or substantially identical in construction, or not identical at all, and generally or substantially of equal size and dimensions, or not of equal size and dimensions, without departing from the spirit and scope of the invention.

According to a feature of the exemplary embodiment of the present invention, end sections 102, 114 are provided, at proximal ends thereof, with respective support structures 108, 112 each configured to support one or more elements of a closure device/mechanism 103 for releasable securing a closure flap or panel 116 to the corresponding end section to close the top opening (i.e., in a closed position or state of closure panel 116), and/or one or more elements of coupling structures A, B for releasably coupling end sections 102, 114 to one another or to one or more extension sections (e.g., extension section 160 in FIG. 5) releasably coupled between end sections 102, 114, as described in more detail below. In the exemplary embodiment shown in FIG. 1, each support structure 108, 112 is a semi-rigid or flexible cross-member (e.g., a transverse piece) in the shape of a strip (long and narrow) connected to and extending between the side portions (i.e., 102*a*, 102*b* and 114*a*, 114*b*) of the corresponding end section, that is, each strip-shaped cross-member (hereinafter also "strip") extends in the width direction of the end section. It will be readily appreciated that by the construction of strips 108, 112 and corresponding arrangement relative to other parts of the corresponding end section, each strip 108, 112 provides a reliable support structure that enhances the overall structural integrity and protective capability of bag 100.

According to another feature of the exemplary embodiment of the present invention, the proximal ends of end sections 102, 114 are provided with closed perimeter portions from which respective coupling structures A, B extend. For end section 102, the closed perimeter portion is a continuous (i.e., uninterrupted) perimeter defined partially by strip 108, side portions 102*a*, 102*b*, and bottom portion 102*c*. Similarly, for end section 114 the closed perimeter portion is a continuous (i.e., uninterrupted) perimeter defined partially by strip 112, side portions 114*a*, 114*b*, and bottom portion 114*c*. The closed perimeter portions of end sections 102, 114 define respective openings 120, 121 (second access openings) providing access into pockets 105 of end sections 102, 114. Thus, in the exemplary embodiment shown in FIG. 1, opening 120 is bordered at the top by strip 108 and at three sides by side portions 102*a*, 102*b* and bottom portion 102*c* to define the closed perimeter portion of end section 102. Likewise, opening 121 is bordered at the top by strip 112 and three sides by side portions 114*a*, 114*b* and bottom portion 114*c* to define the closed perimeter portion of end section 114. While the first access openings function as the primary means by which the one or more surfboards and accessories are inserted into and arranged in pockets 105 of end sections 102, 114 when end sections 102, 114 are releasable coupled together and closure panels 116 are in an open position or state, as shown in FIG. 1, it will be appreciated that prior to end sections 102, 114 being releasably coupled together as further described below, second access openings 120, 121 provide alternative means for inserting and arranging such contents into pockets 105, as well as for removing the same therefrom.

Figure 4A:
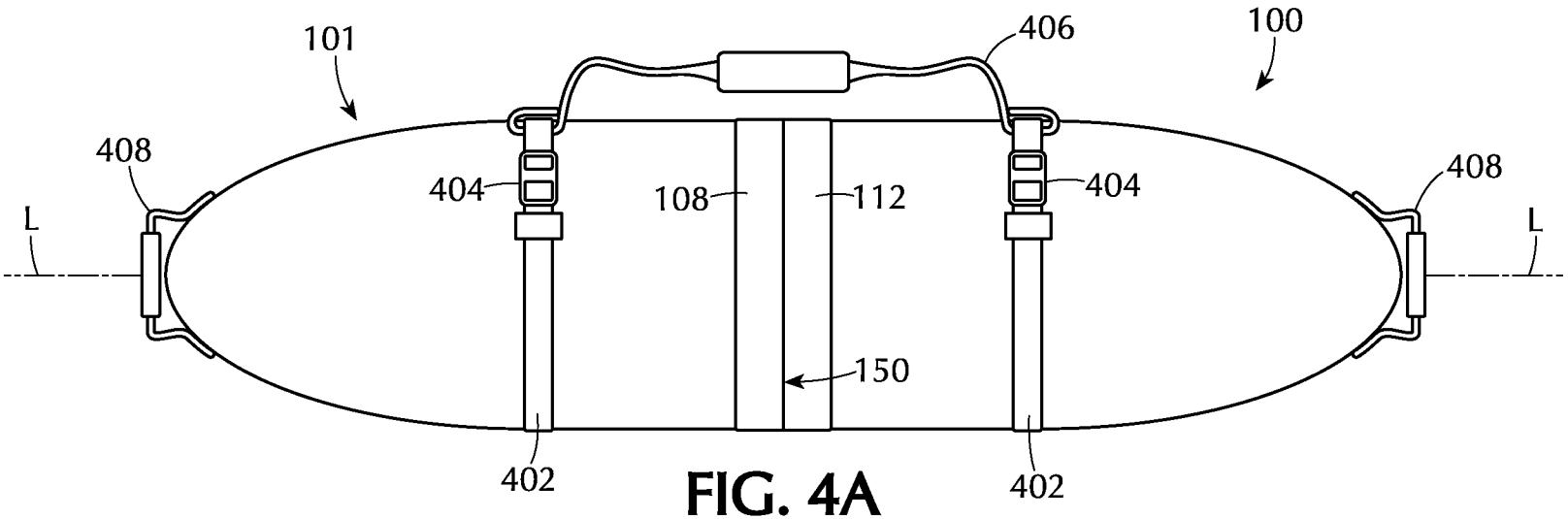
FIG. 4A is a side view of the adjustable carry bag of FIG. 2 with the closure flaps in a fully closed position and incorporating a strap assembly and a handle mechanism for carrying the adjustable carry bag.
Figure 4B:
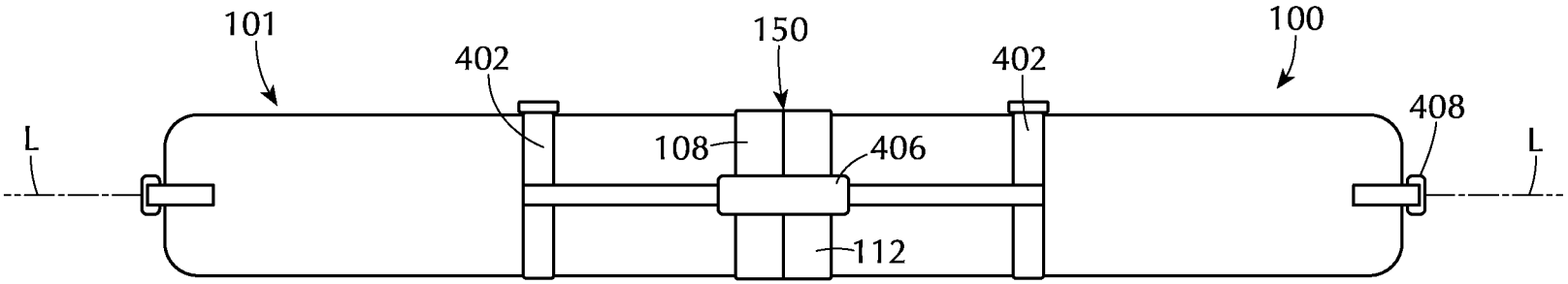
FIG. 4B is a top view of the adjustable carry bag shown in FIG. 4A.

According to a feature of the exemplary embodiment of the present invention, it will be appreciated that in the coupled state of end sections 102, 114 (e.g., FIG. 2), the closed perimeter portion of each end section 102, 114 (as well as the corresponding coupling structure A, B) encircles a preselected region of the interior space of bag 100 that is configured to accommodate therein the bag content (e.g., surfboard). This configuration of the closed perimeter portion relative to the interior space of bag 100 is achieved when the top openings (first access openings) of end sections 102, 114 are in both a closed state (i.e., closure panels 116 are in the closed position), such as shown in FIGS. 4A-4B, and in an open state (i.e., closure panels 116 are in the open position), such as shown in FIG. 6 described below. In the exemplary embodiments shown in FIGS. 4A-4B and 6 for example, the closed perimeter portion of each end section 102, 114 and corresponding coupling structure A, B completely encircle (i.e., by 360 degrees) the preselected region of the interior space. Additionally, in the embodiment shown in FIGS. 1-2, the preselected region corresponds to a generally central region of bag 100. It is understood, however, that the preselected region may correspond to a region of bag 100 other then the generally central region, such any other region between the distal end portions of end sections 102, 104 when coupled together to form bag 100. For example, the location of the preselected region of bag 100 may be determined in accordance with selected dimensions of end sections 102, 114, such as when the end sections have different lengths from one another.

Coupling structures A, B, corresponding to another feature of the present invention, are provided at the respective proximal ends of end sections 102, 114 so as to extend from the respective closed perimeter portions and are configured to securely releasably couple end sections 102, 114 together around the entire closed perimeter portions, such as shown in FIG. 2. This structural arrangement provides the means for 360 degree connection between end sections 102, 114 at the proximal (connecting) ends thereof. For clarity of illustration only, in FIG. 1 coupling structures A, B according to the exemplary embodiment are denoted only by zipper elements 106*a*, 110*a*. For coupling structure A of end section 102, zipper elements 106*a* are provided on outer edges of side portions 102*a*, 102*b*, outer edge of bottom portion 102*c*, and outer edge of strip 108. For coupling structure B of end section 114, zipper elements 110*a* are provided on outer edges of side portions 114*a*, 114*b*, outer edge of bottom portion 114*c*, and outer edge of strip 112. Coupling structures A, B define releasable coupling means for releasably coupling end sections 102, 114 together, and the specific construction of coupling structures A, B and releasable connection to one another according to the exemplary embodiment is described below with reference to FIGS. 3A-3C.

As described above, strips 108, 112 are configured to support one or more elements of the closure mechanism for releasably attaching one of the closure panels 116 to each of end sections 102, 114 and/or one or more elements of coupling structures A, B for releasably coupling end sections 102, 114 to one another. In the exemplary embodiment shown in FIG. 1, one of the long sides (inner edge) of strip 108 supports elements (e.g., zipper elements) of closure mechanism 103 for end section 102, and the other, opposite long side (outer edge) of strip 108 supports elements (e.g., zipper elements) of coupling structure A for end section 102. Likewise, one of the long sides (inner edge) of strip 112 supports elements (e.g., zipper elements) of closure mechanism 103 for end section 114, and the other, opposite long side (outer edge) of strip 112 supports elements (e.g., zipper elements) of coupling structure B which is configured to be releasably coupled to coupling structure A as further described below. Thus, as another feature of the exemplary embodiment of the present invention, it will be appreciated that strips 102, 114 not only provide a reliable support structure that enhances the overall structural integrity and protective capability of bag 100, as noted above, but also function as a support structure for elements of the closure mechanism between closure panels 116 and end sections 102, 114 and a support structure for elements of coupling structures A, B for releasably coupling end sections 102, 114 to one another.

In FIG. 1, each of closure panels 116 is shown in an open position so as to provide access into pockets 105. Closure panels 116 are hingedly connected along one edge thereof to an edge of the corresponding end section. Remaining edges of each of end sections 102, 114 and corresponding closure panel 116 are associated with the closure mechanism 103, such as a conventional zipper, for closing and opening the bag 100. Zipper 103 extends around a peripheral edge of each end section 102, 114 and along an inner edge of the corresponding strip 108, 112, except along the hingedly connected edges of the panel and the end section. Thus, as illustrated in FIG. 1, zipper 103 on the peripheral edge of each end section 102, 114 extends from the corresponding strip 108, 112 toward a distal end of corresponding end section 102, 114. In the exemplary embodiment shown in FIG. 1, only zipper elements of zipper 103 are shown for clarity of illustration only. However, it is understood by those skilled in the art that zipper 103 is configured to employ a zipper slider that slides in a substantially clockwise direction (as seen in FIG. 1) to close the bag 100 and in a substantially counter-clockwise direction to open the bag 100, as is well-known in the art.

End sections 102, 114 and closure panels 116 of bag 100 are made of known materials used for existing surfboard bags, such as durable flexible materials. For enhanced protection, for example, end sections 102, 114 and closure panels 116 are provided with padding throughout, such as flexible high density foam padding. For example, 10 mm flexible high density foam padding provides good protection. An outer fabric of high-denier material, such as nylon, may be used to cover outer surfaces of end sections 102, 114. The material selected is preferably substantially or completely waterproof and is highly durable so as to protect the surfboard(s) and outer surfaces of end sections 102, 114 from the elements. Inner surfaces of bag 100, including pockets 105 and surfaces 116*a* of closure panels 116, may be covered with a suitable liner, such as a tarp liner. Each of end sections 102, 114 and closure panels 116 may therefore have a multilayer construction formed of a flexible padding sandwiched between a layer of nylon and a layer of tarp.

Strips 108, 112 may be formed of various types of flexible and/or semi-rigid materials. For example, strips 108, 112 may be flexible with the same multilayer construction described above for end sections 102, 114 and closure panels 116 (i.e., a high density flexible foam core sandwiched between nylon and tarp outer coverings). Alternatively, a layer of a semi-rigid material, such as plastic, may be added to the multilayer construction (e.g., between the flexible padding and the nylon covering) to make the strips 108, 112 semi-rigid. Such semi-rigid construction allows the bag to be held open, making it easier to insert one or more surfboards into and arrange the same within the interior space of bag 100. This may be further enhanced by forming the layer of semi-rigid material with a curvature (i.e., bow-shaped). Through easy access to the boards after being placed in bag 100, additional padding may be added to vulnerable areas of the packed boards, and additional accessories and travel items may be packed in the bag. The length of each strip 108, 112 is selected so as to correspond to the width of the corresponding end section 102, 114 at the proximal end thereof as shown in FIG. 1. The width of each strip 108, 112 (i.e., the dimension of each strip 108, 112 in the length direction L) is selected so as to provide a reliable support structure for supporting the corresponding elements of the closure mechanism and coupling structures A, B as set forth above, and to enhance the overall structural integrity and protective capability of bag 100. For example, the length and width of each strip 108, 112 may be selected in accordance with the exemplary dimensions for the end sections 102, 114 as described below with reference to FIG. 2. In such exemplary embodiment, each strip 108, 102 may have a width in the range of about 2" to about 3", for example.

FIG. 2 shows bag 100 of FIG. 1 with end sections 102, 114 coupled together in accordance with the exemplary embodiment of the present invention, showing the 360 degree connection between end sections 102, 114. The circle designated by reference numeral 150 denotes only a section of the releasable coupling means for releasably connecting end sections 102, 114 together, which will be described in detail below with reference to FIGS. 3A-3C. Closure panels 116 are depicted in an open state so as to provided access into pockets 105 of bag 100 for the insertion and removal of contents into and from pockets 105 as described above. Thus FIG. 2 illustrates bag 100 in its fully assembled configuration and ready for use, with end sections 102, 114 directly coupled together and without any extension section, as further described below, interposed and coupled between end sections 102, 114. The dimensions of end sections 102, 114 may be selected so that in the assembled state shown in FIG. 2, the overall dimensions of bag 100 conform to standard dimensions for board bags in the industry. For example, the overall length (i.e., in the length direction L) of bag 100 shown in FIG. 2 may be about 6'8" so as to accommodate correspondingly dimensioned boards (e.g., one or more short boards with a length in the range of about 5'8" to about 6'8").

It will be appreciated from the exemplary embodiment shown in FIGS. 1 and 2 and the foregoing description that the end sections 102, 114 can be readily securely coupled together by coupling structures A, B to form bag 100 while the closed peripheral portions and coupling structures A, B encircle the contents (e.g., surfboards) in a generally central region of bag 100 as described above. More specifically, in the coupled state of bag 100 shown in FIG. 2, strips 108, 112 (with corresponding coupling structures A, B extending therefrom) form a cross-member in the form of a brace across a region of an opening (i.e., providing access into the interior space of bag 100) of bag 100 that negatively blocks direct access from the top of the opening, and the closed peripheral portions of end sections 108, 112 and coupling structures A, B extending therefrom create a uniform and continuous surface or tube section around the entire circumference (360 degrees) of bag 100. The brace facilitates provision of a strong connection between sections 102, 114, particularly for carry bags made of soft, flexible materials. As further described below for the exemplary embodiment of coupling structures A, B, the uniform and continuous surface or tube section around the entire circumference (360 degrees) of bag 100 allows a single zipper to fully attach end sections 102, 114 together into the completed bag 100.

End sections 102, 114 and closure panels 116 of bag 100 in the exemplary embodiment of FIGS. 1-2 are illustrated with a substantially curved outer configuration or profile. It is understood, however, that this and other exemplary embodiments described below are not limited to the specific shapes, configurations and/or profiles illustrated in the figures, but may include other shapes, configurations and/or profiles that may be created according to manufacturing processes. Accordingly, changes to the shape configurations and/or profiles shown can be appropriately made without departing from the gist of the invention.

Figure 3A:
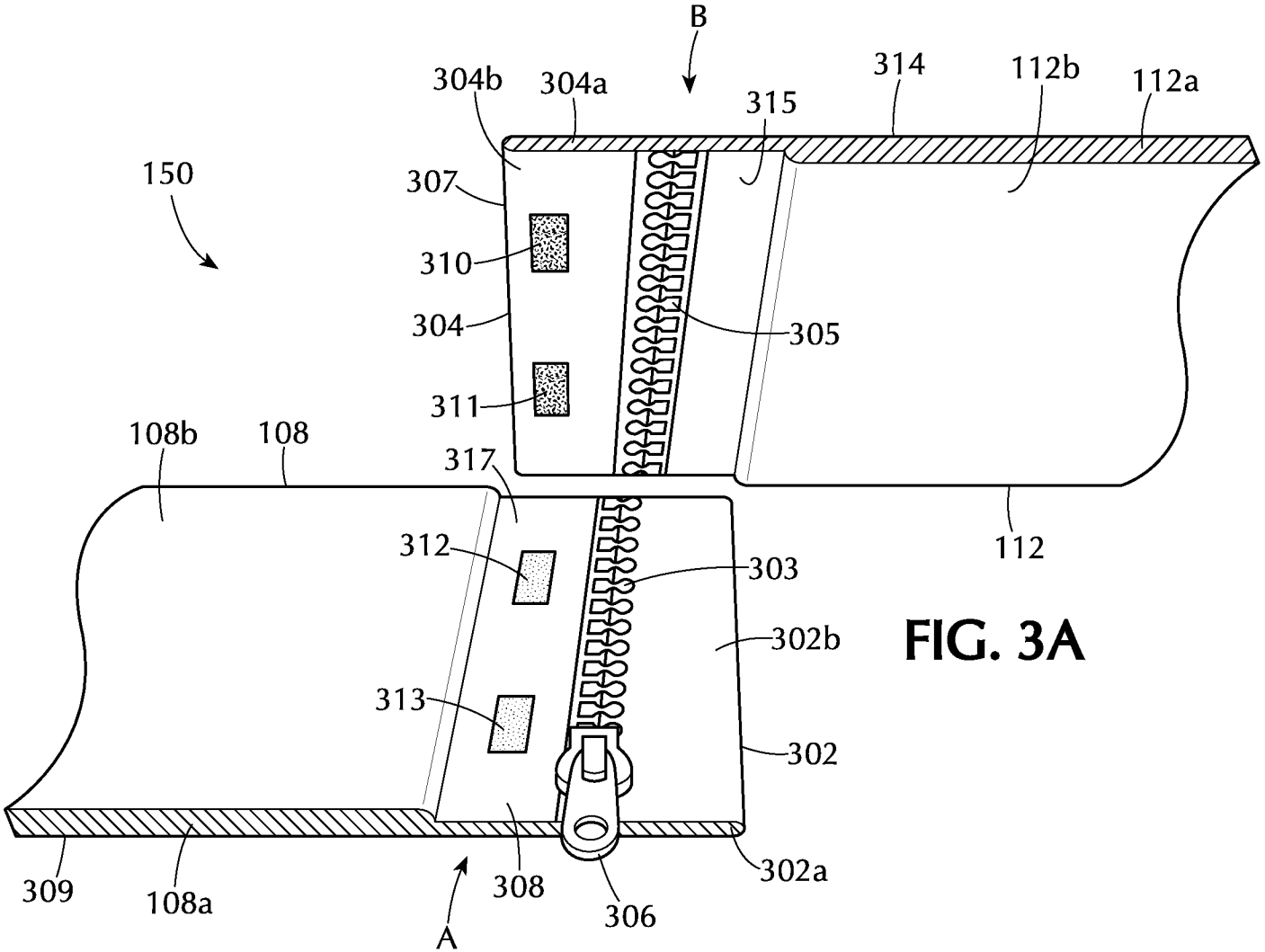
FIG. 3A is an enlarged view of coupling structures for securely coupling together the end sections and/or one or more extension sections of the adjustable carry bag according to the present invention, the coupling structures being shown in an initial, uncoupled state.
Figure 3B:
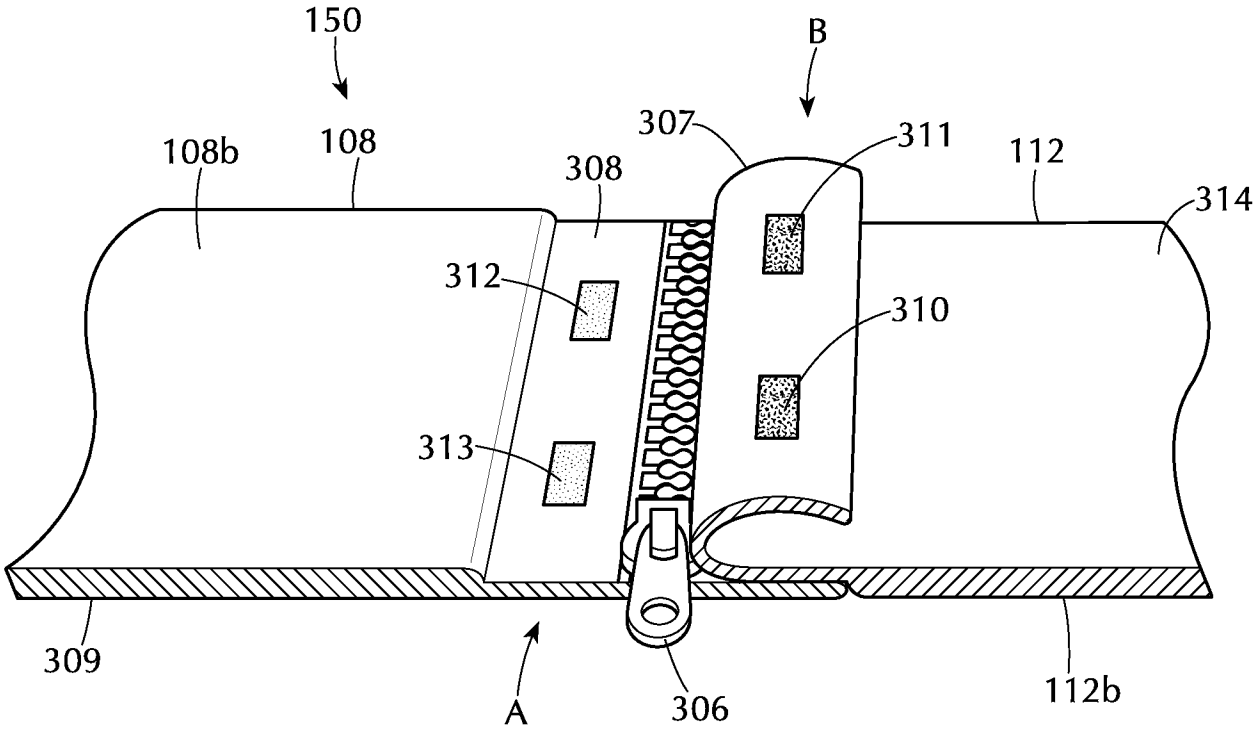
FIG. 3B is an enlarged view showing the coupling structures of FIG. 3A in an intermediate, partially coupled state.
Figure 3C:
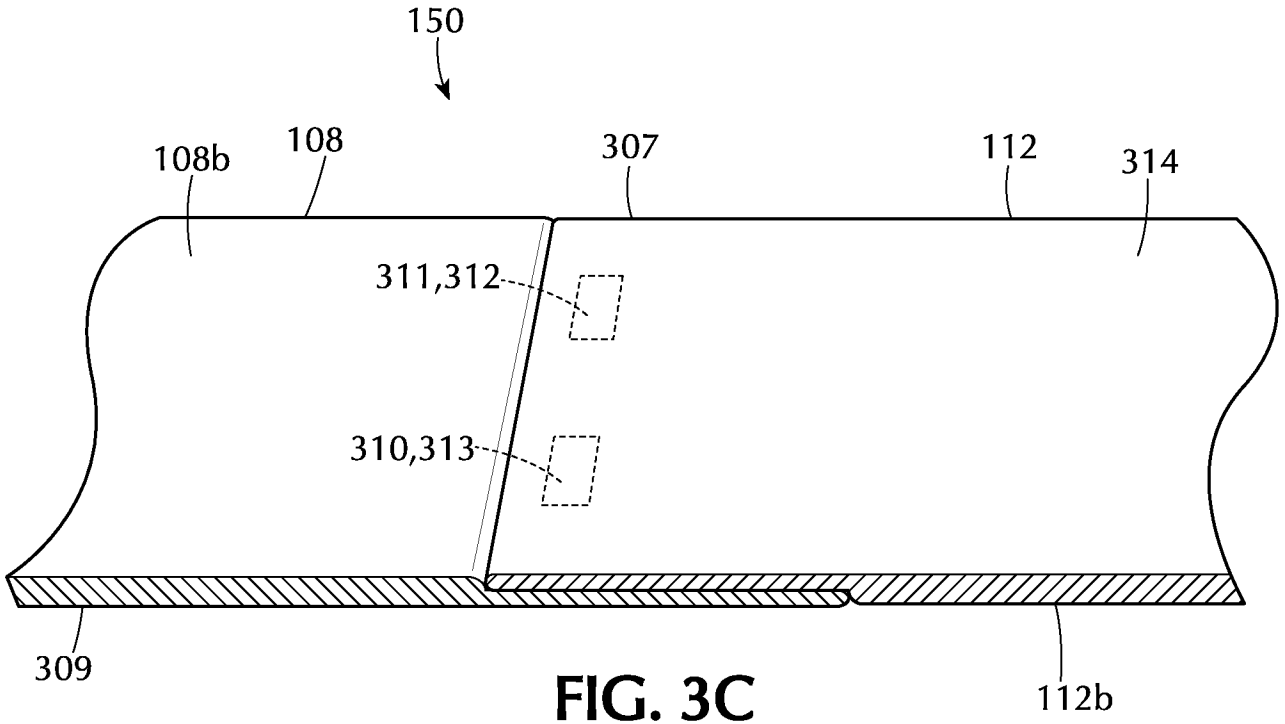
FIG. 3C is an enlarged view showing the coupling structures of FIGS. 3A-3B in a fully coupled state and corresponding to the state in which the end sections of the adjustable carry bag are securely coupled together to form a complete carry bag.

FIGS. 3A-3C show the releasable coupling means for releasably coupling end sections 102, 114 of bag 100 together. FIGS. 3A-3C are enlarged views of the section denoted by the circle 150 in FIG. 2 and illustrate a sequence corresponding to various stages for coupling end sections 102, 114 together using coupling structures A, B noted above with reference to FIG. 1, where FIG. 3A shows coupling structures A, B in an initial, uncoupled state, FIG. 3B shows coupling structures A, B in an intermediate, partially coupled state, and FIG. 3C shows coupling structures A, B in a fully coupled state and corresponding to the state in which end sections 102, 114 of bag 100 are securely coupled together. FIGS. 3A-3C only show a section of the releasable coupling means to facilitate illustration. In FIG. 1 and in further exemplary embodiments described below, the releasable coupling means are denoted generally by coupling structures A, B which extend from the respective closed peripheral portions and extend around the entire circumference of the proximal ends of end sections 112, 114. Referring to FIGS. 3A-3B, coupling structures A, B extend from strips 108, 112, respectively, and have respective base substrates 302, 304 supporting a closure device which, in this exemplary embodiment, is in the form of a single zipper including a first row 303 and a second row 305 of zipper elements (teeth) mounted on respective base substrates 302, 304 via respective zipper tapes 315, 317, and a zipper slider 306. When fully zipped, the single zipper provides the primary means for attaching end sections 102, 114 together with a 360 degree connection, as described above, into the completed bag 100. This is made possible by the uniform and continuous surface or tube section around the entire circumference of bag 100 created by the closed peripheral portions and respective coupling structures A, B of end sections 102, 114 as described above. Coupling structure B includes a flap portion 307 configured to be releasably attached to a corresponding portion 308 of coupling structure A by hook-and-loop fasteners 310-313 when end sections 102, 114 are fully attached together, as further described below with reference to FIG. 3C. When hook-and-loop fasteners 310-313 are connected together, as shown in FIG. 3C, flap portion 307 provides protection to the zipper, such as from exposure to rain and other wet environments. Flap portion 307 also protects the zipper from damage during transportation of bag 100. Flap portion 307 is also flexible, as shown in FIG. 3B, to allow clearance for operating zipper slider 306. In addition or alternatively to flap portion 307, a water resistant zipper may be used.

Base substrates 302, 304 may be formed of various types of semi-rigid or flexible materials, such as a high density foam core sandwiched between nylon and tarp coverings, similar to the construction for respective strips 108, 112 as described above. For example, for strip 108 and base substrate 302, foam cores 108*a*, 302*a* are sandwiched between coverings 108*b*, 302*b* and tarp liner 309. Likewise, for strip 112 and base substrate 304, foam cores 112*a*, 304*a* are sandwiched between nylon covering 314 and nylon covering 304*b*/tarp liner 112*b*.

In the exemplary embodiment shown in FIGS. 3A-3C, foam cores 108*a*, 302*a* are formed from a single piece of foam material, with foam core 108*a* having a greater thickness than that of foam core 302*a*. Foam cores 112*a*, 304*a* are formed from a single piece of foam material, with foam core 112*a* having a greater thickness than that of foam core 304*a*. The thicknesses of foam cores 112*a*, 108*a* are equal or substantially equal to one another, and the thicknesses of foam cores 302*a*, 304*a* are equal or substantially equal to one another. In a preferred embodiment, for example, the thickness of each of foam core 108*a*, 112*a* may be about 10 mm, and the thickness of each of foam cores 302*a*, 304*a* may be about 5 mm. By this construction, when coupling structures A, B are securely coupled together (e.g., zipped) as shown in FIG. 3C, outer surfaces of strips 108, 112 and an outer surface of flap portion 307 of coupling structure B are substantially flush with one another. This facilitates provision of the uniform and continuous surface or tube section around the entire circumference (i.e., 360 degree connection) of bag 100 as described above. It will be appreciated by those skilled in the art that each pair of foam cores 108*a*, 302*a* and 112*a*, 304*a* need not be formed from a single piece of material, but may be instead formed of different pieces of material integrally secured together, such as by a suitable adhesive and/or fastener(s). Additionally, the specific thicknesses for foam cores 108*a*, 302*a* and 112*a*, 304*a* and corresponding dimensional relationships may be different from those described above, so long as the resulting upper surfaces of strips 108, 112 and upper surface of flap portion 307 of coupling structure B are substantially flush with one another as noted above.

Moreover, in the exemplary embodiment shown in FIGS. 3A-3C, only four pieces of hook-and-loop fastener elements 310-313 are shown corresponding to the sections of the coupling means 150 in the partially exploded views. It will be understood, however, that coupling structures A, B may be provided with multiple pieces of hook-and-loop fastener elements extending along the continuous surface or tube section around the entire circumference of bag 100. Furthermore, while the coupling means 150 in the exemplary embodiment employs separate pieces of hook-and-loop fastener elements for each coupling structure A, B, it will be appreciated that each coupling structure A, B may be provided with a single, continuous piece of hook-and-loop fastener extending along the continuous surface or tube section around the entire circumference of bag 100. Alternatively, other suitable fasteners may be substituted for the hook-and-loop fasteners without departing from the spirit and scope of the invention, such as snap-type fasteners and the like.

It will also be appreciated that in the exemplary embodiment of the coupling means 150 shown in FIGS. 3A-3C, certain elements of the zipper, such as insert pin, boxpin and retaining box, are omitted for clarity of illustration only. Furthermore, while zipper slider 306 is provided on coupling structure A, zipper slider 306 may alternatively be provided on coupling structure B. It will be further appreciated that coupling structures A, B are not limited to connection with a zipper, and that other suitable connecting methods/structures may be employed, such as clips and hook-and-loop straps.

FIG. 3B shows coupling means 150 with coupling structures A, B in an intermediate, partially coupled state, with the zipper being partially zipped and hook-and-loop fasteners 310, 311 not yet being attached to respective hook-and-loop fasteners 313, 312. Flap portion 307 is partially folded in a direction to the right in FIG. 3B and illustrates the flexible nature of flap portion 307 that allows clearance for operating zipper slider 306 during connection and disconnection of coupling structures A, B relative to one another. FIG. 3C shows coupling structures A, B in a fully coupled state and corresponding to the state in which end sections 102, 114 of bag 100 are securely coupled together. Upper surfaces of strips 108, 112 (denoted by coverings 108*b*, 314 in FIG. 3C) and upper surface of flap portion 307 of coupling structure B are substantially flush with one another, thereby facilitating provision of the uniform and continuous surface or tube section around the entire circumference (i.e., 360 degree connection) of bag 100 as described above.

It will be appreciated from the foregoing description that strips 108, 112 not only serve to enhance the structural integrity and protective capability of bag 100 by facilitating the 360 degree connection across end sections 102, 114 and a continuous seal on all closure flaps or closure panels 116, but also provide a support structure for both a portion of zipper elements 103 for zippering closure panels 116 and corresponding coupling structures A, B, including zipper elements 303, 305.

FIG. 4A is a side elevational view of bag 100 in FIG. 2 with closure panels 116 in a fully closed (zipped) position, and FIG. 4B is a top view of bag 100 in FIG. 4A. Bag 100 includes a strap assembly having one or more straps 402 which are adjustable in length and which preferably encircle the entire bag 100. Straps 402 may include buckle-type connectors 404 for permitting straps 402 to be selectively separated and reattached. A shoulder or carry strap 406 may be coupled to straps 402 to facilitate the carrying of bag 100. Additionally, handles 408 are provided on opposite sides of bag 100 to further facilitate carrying of bag 100. It will be understood that the strap assembly, carry strap and handles may be modified in any manner recognized in the art without departing from the spirit and scope of the invention. It will also be appreciated that the strap assembly, carry strap and handles have been omitted from FIGS. 1-3C for clarity of illustration only.

FIGS. 5-8 illustrate the adjustable feature of bag 100 which can be adjusted in the length direction L by adding one or more removable sections (extension sections) between end sections 102, 114 of bag 100 shown in FIGS. 1-2, as further described below. FIG. 13 also illustrates the adjustable feature of bag 100 in FIGS. 1-2, but using an extension section of different construction than the extension sections used in the bags of FIGS. 5-8. FIGS. 9-12 illustrate the adjustable feature of other forms of the carrier bag and utilizing one or more extension sections similar to the extension sections of FIGS. 5-8. As used herein, the "length" of each extension section is a dimension of the extension section along the length direction L of bag 100, and the "width" of each extension section is a dimension of the extension section along a direction substantially perpendicular to length direction L of bag 100.

Figure 5:
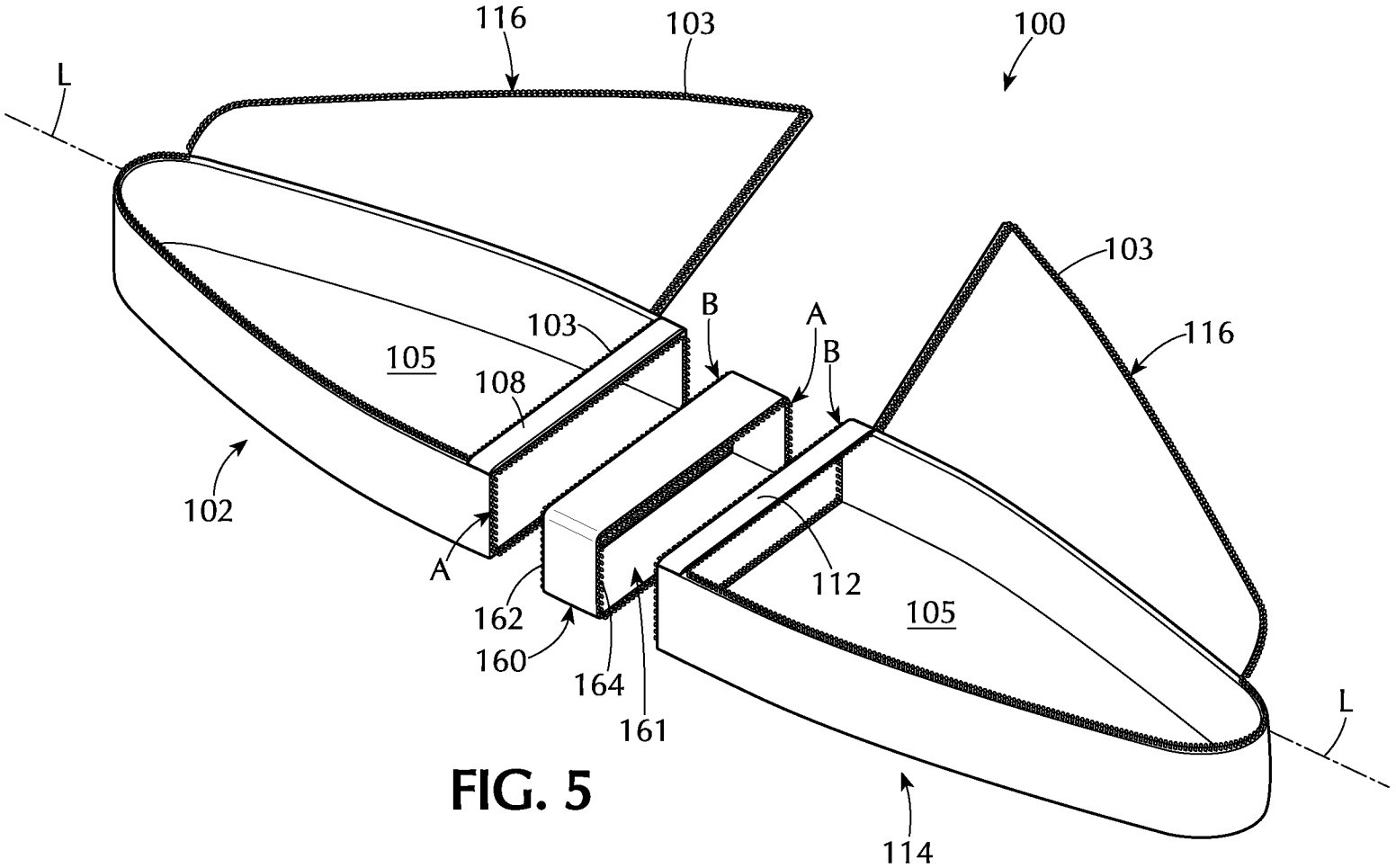
FIG. 5 is an exploded perspective view showing the adjustable carry bag of FIGS. 1-2 with one extension section coupled between the end sections for adjusting the length of the carry bag, the end sections and the extension section being in an uncoupled state.

FIG. 5 is an exploded perspective view of bag 100 showing one extension section 160 interposed between end sections 102, 114 for adjusting the length of bag 100. Bag 100 is shown with end sections 102, 114 and extension section 160 in an uncoupled state and with closure panels 116 in an open position. The length L of bag 100 is adjusted (i.e., increased) by adding (i.e., coupling) extension section 160 between end sections 102, 114 of bag 100. Extension section 160 is also preferably formed of a semi-rigid or flexible material, including a high density flexible foam core with a nylon outer covering, and with inner surfaces lined with a suitable liner, such as a tarp liner, as described above for the multilayer construction of strips 108, 112 in FIGS. 1 and 2. A layer of a semi-rigid material, such as plastic, may be added to the multilayer construction to make extension section 160 semi-rigid, as described above. Extension section 160 is in the form of a continuous piece or tube section having an opening, generally designated 161, extending through the tube section and configured to facilitate insertion therethrough of one or more surfboards and/or accessories that a user wishes to transport in bag 100.

In the exemplary embodiment of FIG. 5, extension section 160 has opposite ends each formed as a closed perimeter portion similar in width and shape to the closed perimeter portions of end sections 102, 114. Opposite ends of extension section 160 are provided with respective coupling structures B, A extending from and around the entire perimeter of the closed perimeter portions and configured to be releasably coupled to respective coupling structures A, B of end section 102, 114. In FIG. 5, coupling structures B, A are denoted only by zipper elements 162, 164 for clarity of illustration only. Coupling structure B of extension section 160 is identical in construction to coupling structure B of end section 114 and is releasably coupled to coupling structure A of end section 102, as described above with reference to FIGS. 3A-3C. Coupling structure A of extension section 160 is identical in construction to coupling structure A of end section 102 and is releasably coupled to coupling structure B of end section 114, as described above with reference to FIGS. 3A-3C. When extension section 160 is coupled to end sections 102, 114 as set forth above, opening 161 of extension section 160 and openings 120, 121 (see FIG. 1) of respective end sections 102, 114 are substantially aligned with one another.

Figure 6:
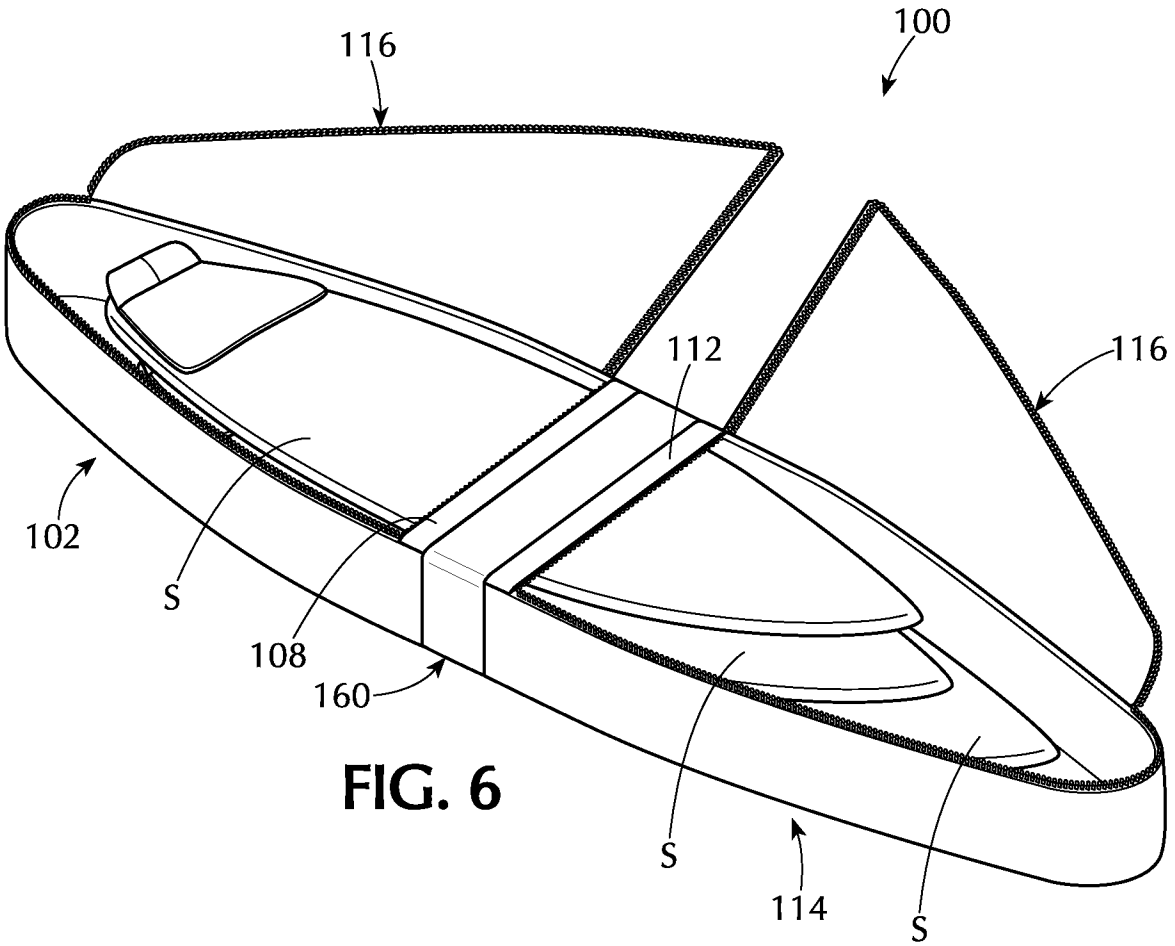
FIG. 6 shows the adjustable carry bag of FIG. 5 with the ends sections and the extension section coupled together in a manner according to the present invention, with multiple surfboards being accommodated within the interior of the adjustable carry bag.

FIG. 6 shows bag 100 of FIG. 5 with end sections 102, 114 securely coupled together via the intermediation of extension section 160 (i.e., a single extension section), with the length of bag 100 being increased by an amount corresponding to the length of extension section 160. FIG. 6, which shows closure panels 116 in an open state, also depicts an example in which three surfboards S of varying lengths are accommodated in bag 100. Surfboards S extend through aligned openings 161, 120 and 121 of extension section 160, end section 102, and end section 114, respectively.

It will be appreciated from the exemplary embodiment shown in FIGS. 5 and 6 and the foregoing description that extension section 160 and end sections 102, 114 can be readily securely coupled together with coupling structures A, B to form bag 100 while the closed peripheral portions of end sections 102, 114, extension section 160, and coupling structures A, B encircle the contents (e.g., surfboards) within the interior space of bag 100 in a region of bag 100 between distal ends of end sections 102, 114 (e.g., a generally central region of bag 100 in FIG. 6). More specifically, in the coupled state of bag 100 shown in FIG. 6, strips 108, 112 and top portions of extension section 160 and coupling structures A, B form a cross-member in the form of a brace across a region of an opening (i.e., providing access into the interior space of bag 100) of bag 100 that negatively blocks direct access from the top of the opening, while the closed peripheral portions of end sections 108, 112, extension section 160, and coupling structures A, B extending therefrom create a uniform and continuous surface or tube section around the entire circumference (360 degrees) of bag 100. Such brace and uniform and continuous surface or tube section are achieved both in the open and closed states of the top opening (first access opening) of each end section 102, 114 as described above for FIGS. 1-2. The advantages of such brace and uniform and continuous surface or tube section is as described above for the embodiment of FIGS. 1-2.

The length of extension section 160 is selected so that a user may be able to fit a surfboard that is longer than bag 100 described above with reference to FIGS. 1-2 and 4A-4B. In exemplary embodiment, extension section 160 may have a length of about 6" or about 12", or any desired length therebetween. For example, when assembled with a 6" extension section, bag 100 would accommodate a majority of short board lengths. For longer board lengths, bag 100 would be assembled with a 12" extension section.

Figure 7:
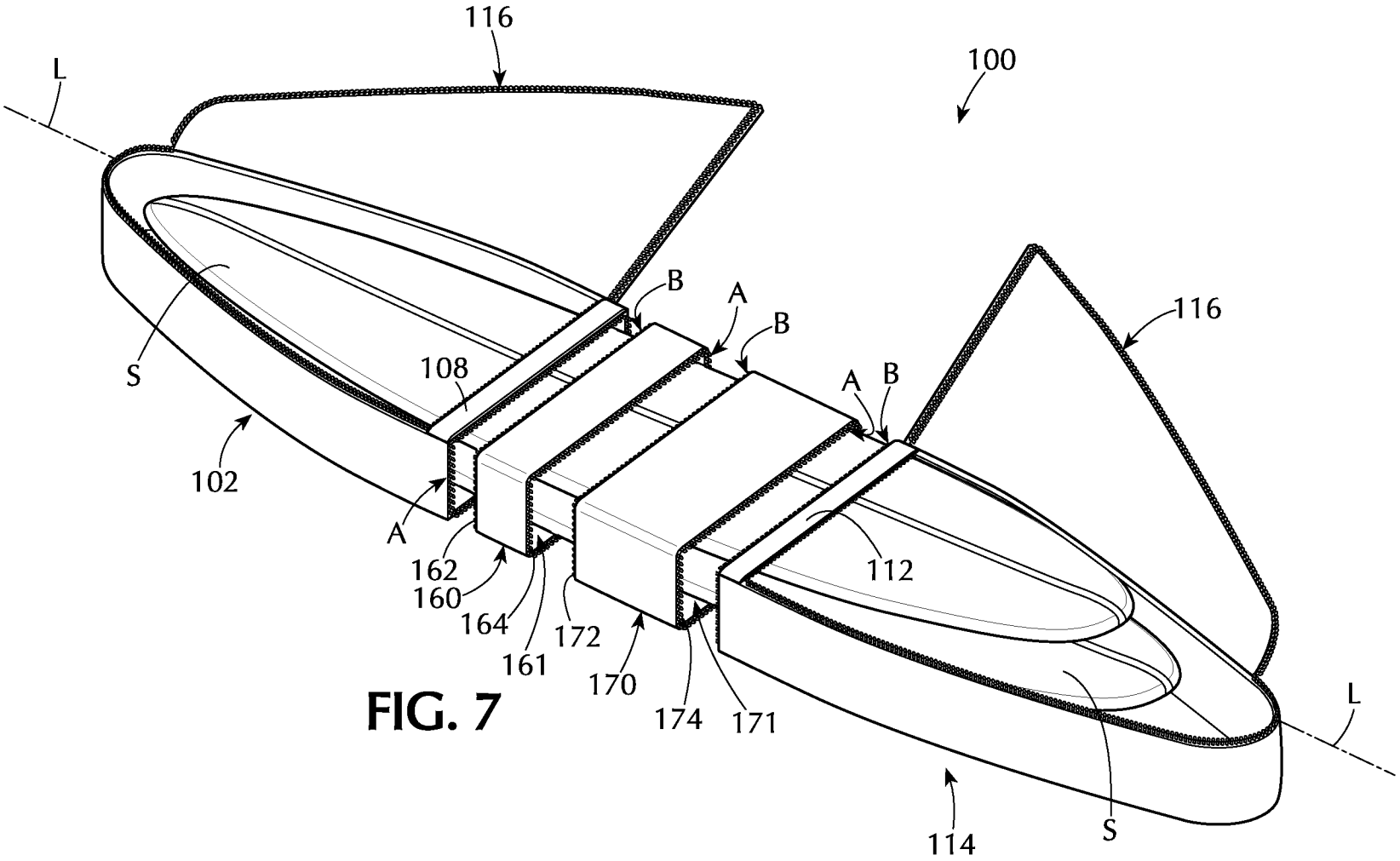
FIG. 7 is an exploded perspective view showing the adjustable carry bag of FIGS. 1-2 with two extension sections coupled between the end sections for adjusting the length of the carry bag, the end sections and extension sections being in an uncoupled state, and multiple surfboards being accommodated within the interior of the adjustable carry bag.

FIG. 7 is an exploded perspective view of bag 100 showing two extension sections 160, 170 interposed between end sections 102, 114 for adjusting the length of bag 100. Extension section 160 corresponds to extension section 160 described above with reference to FIGS. 5-6. Bag 100 is shown with end sections 102, 114 and extension sections 160, 170 in an uncoupled state and with closure panels 116 in an open position Extension section 170 has substantially the same construction as extension section 160, except that extension section 170 is greater in length than extension section 160. For example, when extension section 160 is 6" long, extension section 170 may be 12" in length. As described above, for FIGS. 5-6, when extension section 160 is 6" in length, bag 100 accommodates a majority of short board lengths. For longer board lengths, the 12" long extension section 170 is added as shown in FIG. 7. Extension section 170 has an opening, generally designated at 171, which is configured to be substantially aligned with opening 161 of extension section 160 and openings 120, 121 of end sections 102, 114, respectively, in order to permit insertion therethrough of surfboards S during assembly of bag 100, as shown in FIG. 7, as well as to permit coupling of extension sections 160, 170 to one another and to end sections 102, 114. Thus, when extension sections 160, 170 and end sections 102, 114 are coupled to one another in a fully assembled state of bag 100, openings 120, 121, 161 and 171 are all substantially aligned with one another.

Opposite ends of extension section 170 are provided with respective coupling structures B, A extending around the entire circumference of extension section 170. For clarity of illustration only, in FIG. 7 coupling structures B, A of extension section 170 are denoted only by zipper elements 172, 174. Coupling structure B of extension section 170 is identical in construction to coupling structure B of each of end section 114 and extension section 160, and is configured to be releasably coupled to coupling structure A of extension section 160 as described above with reference to FIGS. 3A-3C. Coupling structure A of extension section 170 is identical in construction to coupling structure A of each of end section 102 and extension section 160, and is configured to be releasably coupled to coupling structure B of end section 114 as described above with reference to FIGS. 3A-3C.

Thus in the exemplary embodiment of FIG. 7, bag 100 is provided with two extension sections 160, 170 of different lengths coupled in series between end sections 102, 114 along the length direction L of bag 100. This embodiment exemplifies the ability for bag 100 to adjust for surfboards of varying lengths. This adjustability is particularly useful if, for example, the user originally purchased bag 100 for a smaller surfboard, but later purchased more surfboards that are substantially longer than the original surfboard purchased, or is traveling with a companion with longer surfboards.

Figure 8:
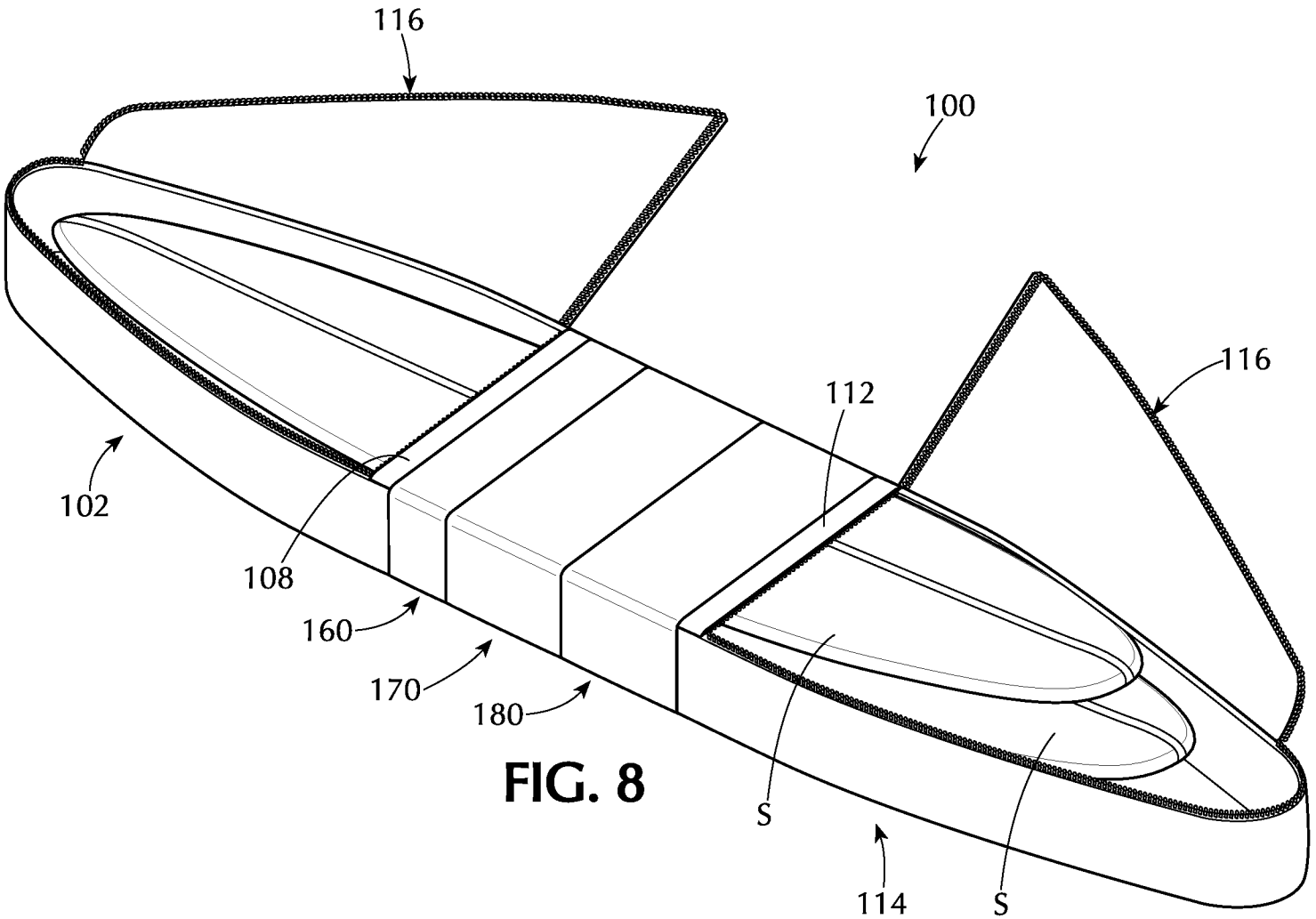
FIG. 8 is a perspective view showing the adjustable carry bag of FIGS. 1-2 with three extension sections coupled between the end sections for adjusting the length of the carry bag, the end sections and the extension sections being coupled together in a manner according to the present invention, and multiple surfboards being accommodated within the interior of the adjustable carry bag.

FIG. 8 is a perspective view of bag 100 showing three extension sections 160, 170, 180 coupled in series between end sections 102, 114 along the length direction L of bag 100 for adjusting the length of bag 100. Bag 100 is shown with end sections 102, 114 and extension sections 160, 170, 180 coupled together and with closure panels 116 in an open position, and with multiple surfboards S accommodated within the interior of bag 100. In this embodiment, extension section 180 is identical in construction (e.g., dimension and configuration) to extension section 170 described above with reference to FIG. 7 and is mounted between extension section 170 and end section 114. Similar to extension sections 160 and 170 described above, opposite ends of extension section 180 are provided with respective coupling structures A, B (not shown), with coupling structure B coupled to coupling structure A of extension section 170 and coupling structure A coupled to coupling structure B of end section 114 in a manner described above with reference to FIGS. 3A-3C. Extension section 180 also has an opening (not shown) that is substantially aligned with openings 161, 171 of respective extension sections 160, 170 and openings 120, 121 of respective end sections 102, 114 for receiving surfboards S therethrough in the manner shown in FIG. 8.

Thus in the exemplary embodiments described above with reference to FIGS. 5-8, the bag 100 employs one (FIGS. 5-6) or multiple (FIGS. 7-8) extension sections 160-180 between end sections 102, 114 which results in an extension of the length of bag 100 described above with reference to FIGS. 1-2 for the purpose of accommodating within bag 100 one or more surfboards of varying lengths and/or surfboard contents. For example, when bag 100 shown in FIG. 2 has an overall length of about 6'8", the addition of a single, 6" extension section 160, as shown in FIGS. 5-6, permits bag 100 to accommodate boards in the range of from about 6'8" to about 7'2" in length, which covers a majority of short board lengths. For longer board lengths, the further addition of 12" extensions would permit bag 100 to accommodate boards up to any length in 6" increments. In FIG. 7, for example, when extension section 160 is 6" long and extension section 170 is 12" long, bag 100 will accommodate boards in the range of from about 6'8" to about 8'2" in length, covering all fun boards and smaller long boards. The addition of a second 12" extension section, as represented for example by extension section 180 in FIG. 8, will accommodate boards of up to about 9'2" in length, covering almost all traveling surf boarders. Most long boarders do not travel with boards longer than 9'2". According to the present invention, by offering extension sections of varying lengths, a user would only need to purchase one bag 100 and can separately purchase extension sections as needed to accommodate boards of varying lengths. It will be appreciated that although one to three extension sections are shown in the exemplary embodiments of the adjustable carry bag, any number of such extension sections can be used and the length of the extension sections can also be varied as can the length of the corresponding end sections.

Figure 9:
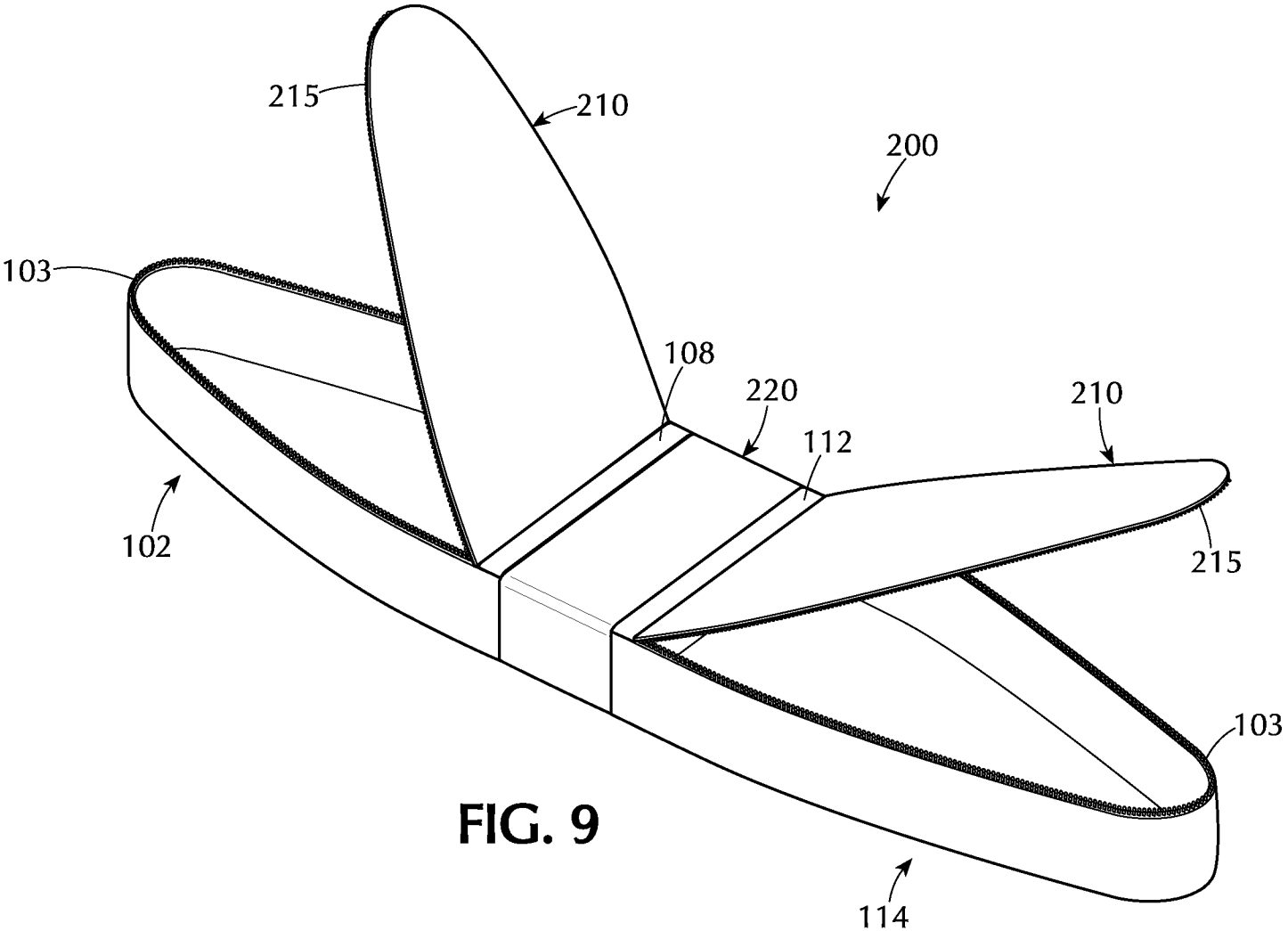
FIG. 9 is a perspective view of another embodiment of the adjustable carry bag according to the present invention.

FIG. 9 is a perspective view of another exemplary embodiment of an adjustable carry bag, generally designated at 200, according to the present invention. Bag 200 includes end sections 102, 114, which are identical in construction to sections 102, 114 of bag 100 described above with reference to FIGS. 5-6, panels 210, and an extension section 220 releasably coupled between end sections 102, 114. Extension section 220 is similar in construction to extension section 160 of FIGS. 5-6 except that extension section 220, as shown, is longer than extension section 160. Similar to extension section 160, extension section 220 includes opposite ends provided with respective coupling structures A, B (not shown), with coupling structure A coupled to coupling structure B of end section 114 and coupling structure B coupled to coupling structure A of end section 102 in a manner described above with reference to FIGS. 3A-3C. Extension section 220 also has an opening (not shown) that is substantially aligned with openings 120, 121 of respective extension end sections 102, 114 for receiving surfboards S therethrough in a manner similar to that described above for FIG. 6.

The primary distinction between bag 200 in FIG. 9 and bag 100 in FIGS. 5-6 is that bag 200 has an alternate hinge placement for closure panels 210 as compared to closure panels 116 of bag 100. In bag 100 of FIGS. 5-6, closure panels 116 are hingedly connected along one edge of respective end sections 102, 114. In contrast, in bag 200 of FIG. 9, panels 210 are hingedly connected along respective inner edges of strips 108, 112 (i.e., the sides of strips 108, 112 opposite to sides thereof containing respective coupling structures A, B). Remaining edges of each of end sections 102, 114 and corresponding panel 210 are provided with a closure device such as a zipper 103, 215 for closing and opening bag 200. The zipper 103 extends around a peripheral edge of each end section 102, 114 and zipper 215 extends around a peripheral edge of each panel 210, except along connecting edges between panels 210 and respective strips 108, 112 of end sections 102, 114. In the exemplary embodiment shown in FIG. 9, only zipper elements of zipper 103, 215 are shown for clarity of illustration only. However, it is understood by those skilled in the art that zipper 103, 215 is configured to employ a zipper slider that slides in a substantially clockwise direction (as seen in FIG. 9) to close the bag 200 and in a substantially counter-clockwise direction to open the bag 200, as is well-known in the art. The materials and dimensions for end sections 102, 114, panels 210, extension 220 and corresponding coupling structures A, B of bag 200 are as described above for bag 100 of FIGS. 5-6.

In FIG. 9, extension section 220 is depicted as having a length greater than the length of extension section 160 shown in FIGS. 5-6. However, it is understood that the length of extension section 220 may be the same or smaller than that of extension section 160. Furthermore, while only a single extension section 220 is shown in FIG. 10 for coupling with end sections 102, 114, it is understood that two or more extension sections may be coupled in series between end sections 102, 114 along the length direction L of bag 200 in a manner similar to bags 100 and 200 described above with reference to FIGS. 7-8.

Figure 10:
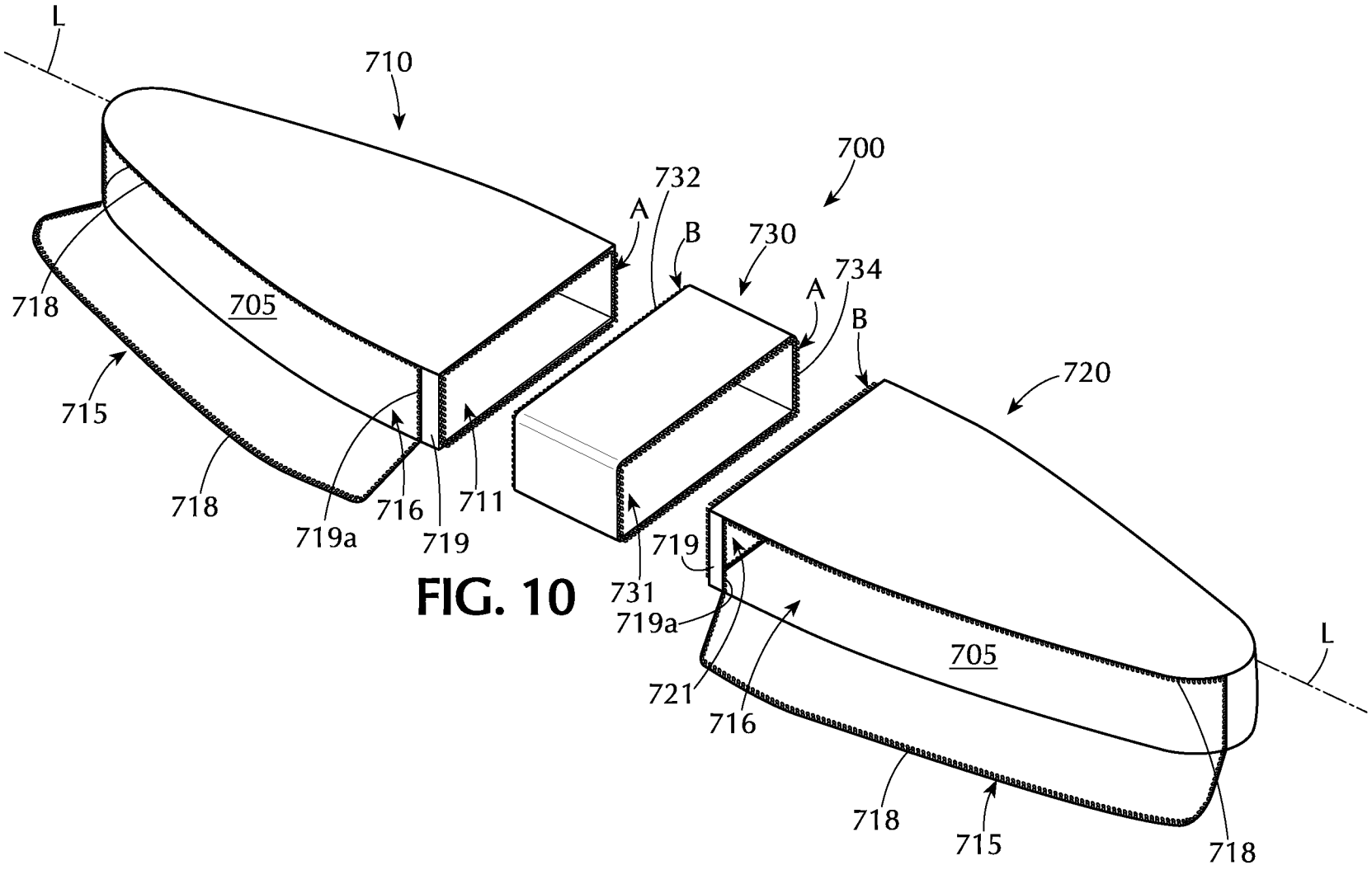
FIG. 10 is an exploded perspective view of a further embodiment of the adjustable carry bag according to the present invention, the adjustable carry bag being shown with the end sections and an extension section in an uncoupled state and with closure flaps shown in an open position.

FIG. 10 is an exploded perspective view of yet another exemplary embodiment of the adjustable carry bag, generally designated at 700, according to the present invention. Bag 700 includes end (nose and tail) sections 710, 720 and an extension section 730 configured to be releasably coupled between end sections 710, 720. Each end section 710, 720 includes top and bottom panels and a side panel (as viewed in the orientation of bag 700 in FIG. 10) and has an opening 716 (first access opening) through which one or more boards are inserted and arranged in a corresponding pocket 705 forming the portion of the interior space of bag 700. Proximal ends of end sections 710, 720 are provided with respective openings (second access openings), generally designated at 711, 721, similar to openings 120, 121 described above with reference to FIG. 1. For each of the end sections, opening 716 is opened and closed by a closure panel 715 hingedly connected along one edge thereof to a lower edge of the bottom panel of the corresponding end section. An edge of closure panel 715 opposite to the hinged edge thereof, and edges of the side and top panels of the corresponding end section are provided with a closure mechanism 718, such as a zipper, for securing the closure panel 715 to the end section to close the opening 716. Similar to the foregoing embodiment, the zipper used can be one of conventional construction without departing from the spirit and scope of the invention. It will be appreciated from the exemplary embodiment of FIG. 10 that the closure panel 715 of each end section 710, 720 has been rotated by 90 degrees to the side of bag 700. Thus, as compared to the bags described above with reference to FIGS. 1-2 and 5-9, bag 700 provides an alternative side access design in which only one side of each end section 710, 720 has the opening 716 (first access opening) providing access into pocket 705.

End sections 710, 720 are also provided, at respective proximal ends thereof, with strips 719 of similar construction to strips 108, 112 described above with reference to FIGS. 1-2 and 5-6, including opposite edges of each strip 719 being provided with respective zipper elements **719*a* for zipper 718 and zipper elements for coupling structures A, B as described below. As compared to the strips for the bags described above with reference to FIGS. 1-2 and 5-9, for each end section 710, 720 strip 719 has been rotated by 90 degrees to the side of bag 700 and is connected to and extends between the top and bottom panels of the corresponding end section 710, 720. The proximal ends of end sections 710, 720 are also provided with coupling structures, generally designated at A, B, respectively, which are identical in construction to respective coupling structures A, B of end sections 102, 114 in bag 100 shown in FIG. 5 and as described above with reference to FIGS. 3A-3C. Extension section 730 is similar in construction to extension section 160 of FIGS. 5-6, except that extension section 730 is shown longer than extension section 160. Similar to extension section 160, extension section 730 includes opposite ends provided with respective coupling structures A, B having respective zipper elements 734, 732, with coupling structure A configured to be coupled to coupling structure B of end section 720 and coupling structure B configured to be coupled to coupling structure A of end section 710 in a manner as described above with reference to FIGS. 3A-3C and 5-6. Extension section 730 also has an opening 731 that is configured to be substantially aligned with openings 711, 721 of respective end sections 710, 720, when extension section 730 is releasably coupled to end sections 710, 720, for receiving surfboards S therethrough in a manner similar to that described above for FIG. 6**.

Extension section 730 is depicted as having a length greater than the length of extension section 160 shown in FIGS. 5-6. However, it is understood that the length of extension section 730 may be the same or smaller than that of extension section 160. Furthermore, while only a single extension section 730 is shown in FIG. 10 for coupling with end sections 710, 720, it is understood that two or more extension sections may be coupled in series between end sections 710, 720 along the length direction L of bag 700 in a manner similar to bags 100 and 200 described above with reference to FIGS. 5-8. Alternatively, it will also be appreciated that end sections 710, 720 of bag 700 may be directly coupled together via respective coupling structures A, B, without any extension section coupled between end sections 710, 720, in a manner similar to end sections 102, 114 as described above for bag 100 with reference to FIGS. 1 and 2.

Similar to end sections 102, 114 in FIGS. 1-2, proximal ends of end sections 710, 720 of bag 700 in FIG. 10 are provided with respective closed perimeter portions from which respective coupling structures A, B extend as described above with reference to FIGS. 3A-3C. For each end section 710, 720 shown in FIG. 10, the closed perimeter portion is defined partially by strip 719, by the top and bottom panels, and one of the side panels of the corresponding end section. In FIG. 10, the formation of the brace across a region of an opening (i.e., providing access into the interior space of bag 700) of bag 700, the uniform and continuous surface or tube section formed around the entire circumference (360 degrees) of bag 700, and corresponding advantages are as described above for the embodiment of bag 100 in FIGS. 5-6. The materials used for bag end sections 710, 720, closure panels 715, extension section 730 and corresponding coupling structures A, B of bag 700 are as described above for bag 100 in FIGS. 5-6.

Figure 11:
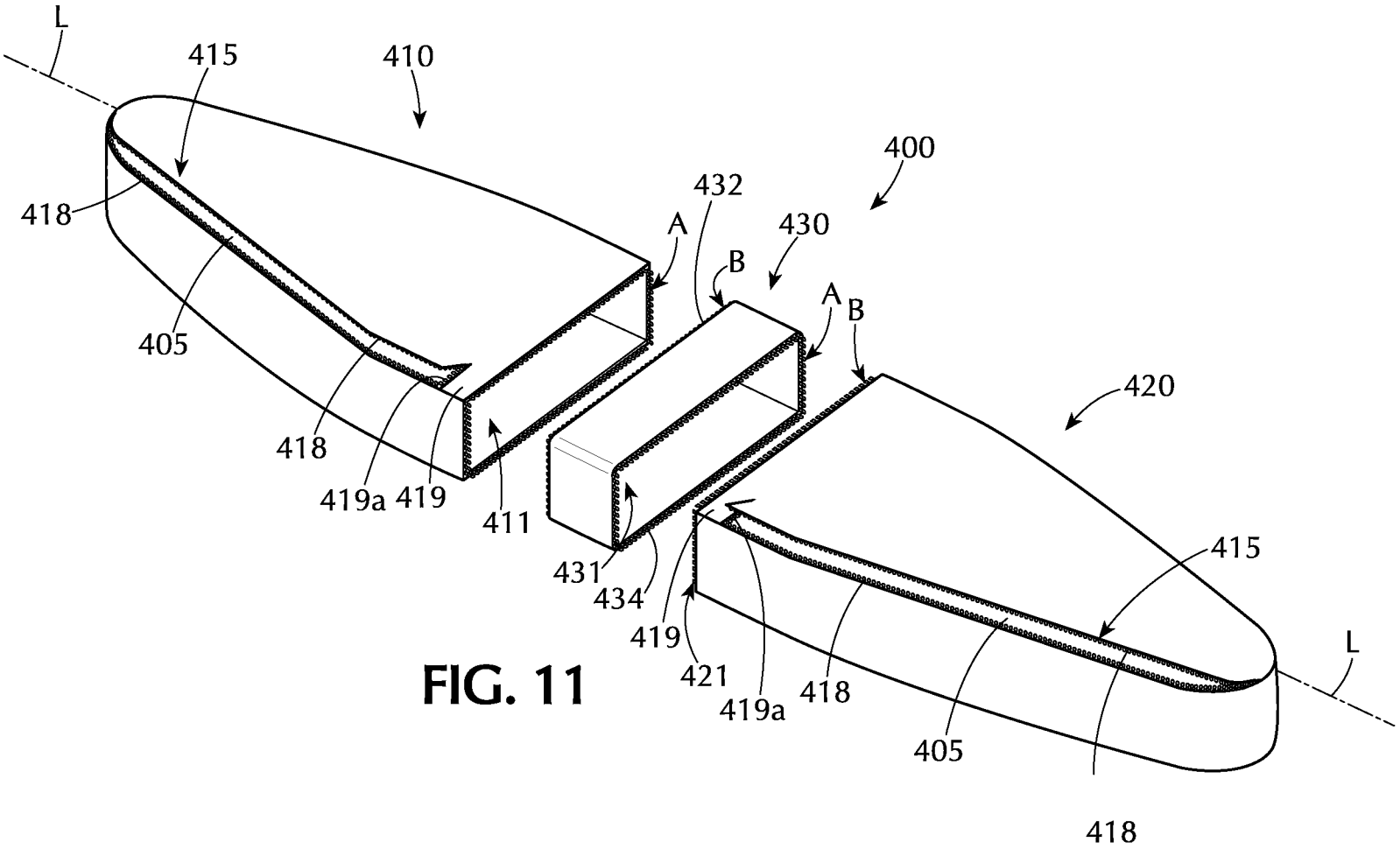
FIG. 11 is an exploded perspective view of another embodiment of the adjustable carry bag according to the present invention, the adjustable carry bag being shown with end sections and an extension section in an uncoupled state and with closure flaps shown in the open position.

FIG. 11 is an exploded perspective view of still another exemplary embodiment of the adjustable carry bag, generally designated at 400, according to the present invention. Bag 400 is a modified version of the alternative access bag design described above with reference to FIG. 10. Bag 400 includes end (nose and tail) sections 410, 420 and an extension section 430 configured to be releasably coupled between end sections 410, 420. Each end section 410, 420 includes top and bottom panels and side panels (as viewed in the orientation of bag 400 in FIG. 11). End sections 410, 420 have openings 405 (first access openings) through which the boards are inserted and arranged into corresponding pockets of the end sections forming the interior space of bag 400. Openings 405 are open and closed via respective closure panels 415 each hingedly connected along an edge thereof to an edge of the top panel (as viewed in the orientation of bag 400 in FIG. 11) of the corresponding end section. For each end section 410, 420, an edge of closure panel 415 opposite to the hinged edge thereof and an edge of one of the side panels of the corresponding end section are provided with a closure mechanism 418, such as a zipper, for securing the closure panel 415 to the end section to close the opening 405. Similar to the foregoing embodiment, the zipper used can be one of conventional construction without departing from the spirit and scope of the invention.

Proximal ends of end sections 410, 420 are provided with respective openings (second access openings), generally designated at 411, 421, similar to openings 120, 121 described above with reference to FIG. 1. It will be appreciated that, as compared to bags 100 and 200 described above, bag 400 in FIG. 11 provides an alternative side access design in which only one side of each end section 410, 420 has the zipper opening 405 through which the pockets are accessed for placement of boards into the interior space of bag 400. The proximal end of each end section 410, 420 is also provided with a support structure in the form of a cross-member 419 which is connected at one end to one side portion of the corresponding end section and extends in the direction toward an opposite side portion of the corresponding end section (i.e., extends in the width direction of the end section). In this embodiment, however, in the width direction of the corresponding end section, each cross-member 419 is shorter than the strip-shaped cross-members described above with respect to the previously described embodiments. It will be appreciated that cross-members 419 may also extend to a distance along the width direction of respective end sections 410, 420 other than as shown in FIG. 11. Similar to the strips 108, 112 described above with reference to the embodiment of FIGS. 1-2, opposite edges of each cross-member 419 are provided with respective zipper elements 419*a* for zipper 418 and zipper elements for coupling structures A, B as described below.

The proximal ends of end sections 410, 420 are also provided with coupling structures, generally designated at A, B, respectively, which are identical in construction to respective coupling structures A, B of end sections 102, 114 in bag 100 shown in FIG. 5 and as described above with reference to FIGS. 3A-3C. Extension section 430 is similar in construction and dimension to extension section 160 of FIGS. 5-6. Similar to extension section 160, extension section 430 includes opposite ends provided with respective coupling structures A, B having respective zipper elements 434, 432, with coupling structure A configured to be coupled to coupling structure B of end section 420 and coupling structure B configured to be coupled to coupling structure A of end section 410 in a manner as described above with reference to FIGS. 3A-3C. Extension section 430 also has an opening 431 that is configured to be substantially aligned with openings 411, 421 of respective extension end sections 410, 420, when extension section 430 is releasable coupled to end sections 410, 420, for receiving surfboards S therethrough in a manner similar to that described above for FIG. 6.

It is understood that the length of extension section 430 may be the same, smaller or greater than that of extension section 160. Furthermore, while only a single extension section 430 is shown in FIG. 11 for coupling with end sections 410, 420, it is understood that two or more extension sections may be coupled in series between end sections 410, 420 along the length direction L of bag 400 in a manner similar to bags 100 and 200 described above with reference to FIGS. 5-8. Alternatively, it will also be appreciated that end sections 410, 420 of bag 400 may be coupled together via respective coupling structures A, B, without any extension section being coupled between end sections 410, 420, similar to end sections 102, 114 of bag 100 as described above with reference to FIGS. 1 and 2.

Similar to end sections 102, 114 in FIGS. 1-2, proximal ends of end sections 410, 420 of bag 400 in FIG. 11 are provided with respective closed perimeter portions from which respective coupling structures A, B extend as described above with reference to FIGS. 3A-3C. For each of the end sections 410, 420 shown in FIG. 11, the closed perimeter portion is defined partially by strip 419 and by top and bottom panels and opposite side panels of the corresponding end section. In FIG. 11, the formation of the brace across a region of an opening (i.e., providing access into the interior space of bag 400) of bag 400, the uniform and continuous surface or tube section formed around the entire circumference (360 degrees) of bag 400 and corresponding advantages are as described above for the embodiment of FIGS. 5-6. The materials used for end sections 410, 420, closure panels 415, extension section 430 and corresponding coupling structures A, B of bag 400 are as described above for bag 100 in FIGS. 5-6.

Figure 12:
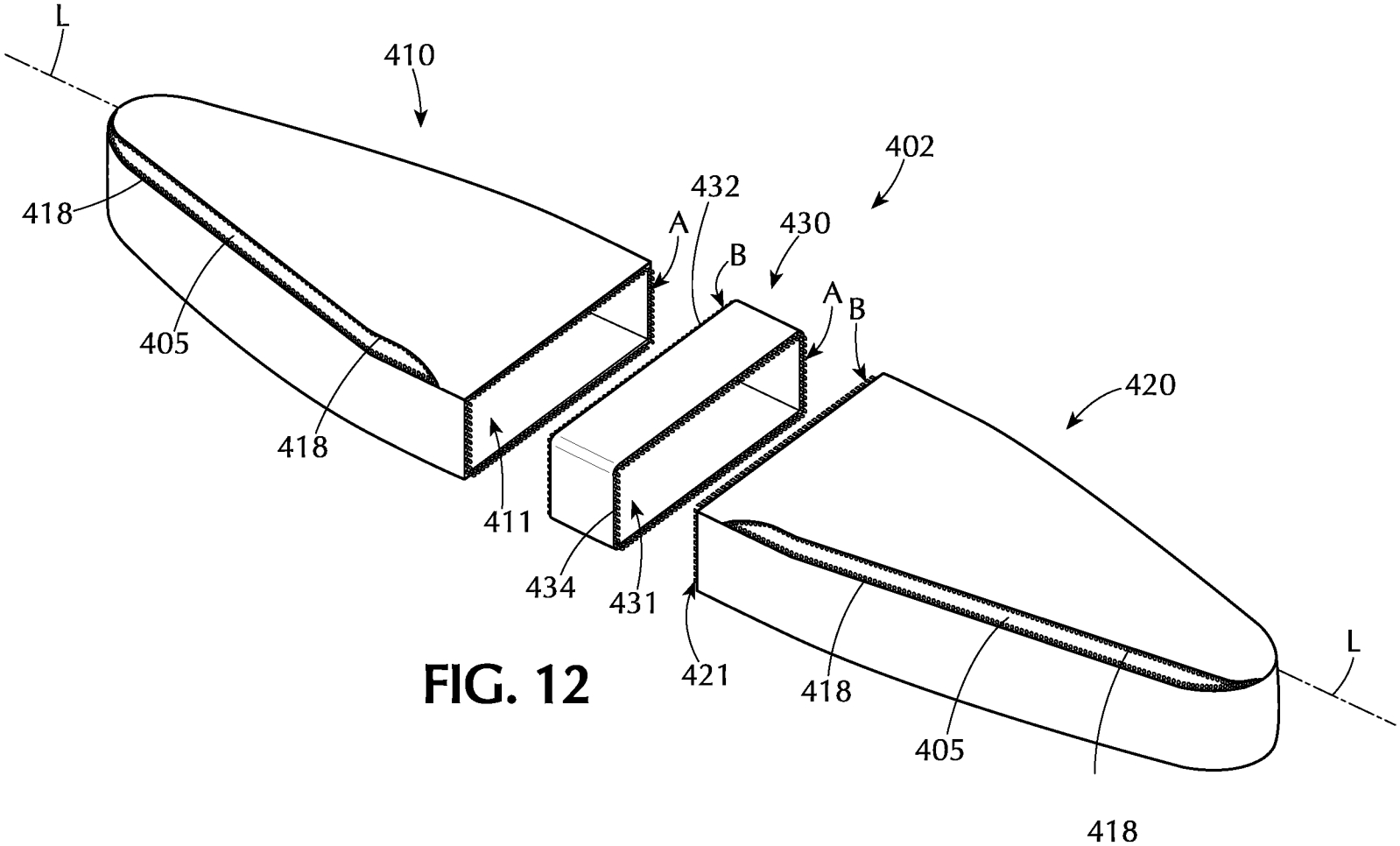
FIG. 12 is a perspective view of yet another embodiment of the adjustable carry bag according to the present invention.
Figure 13:
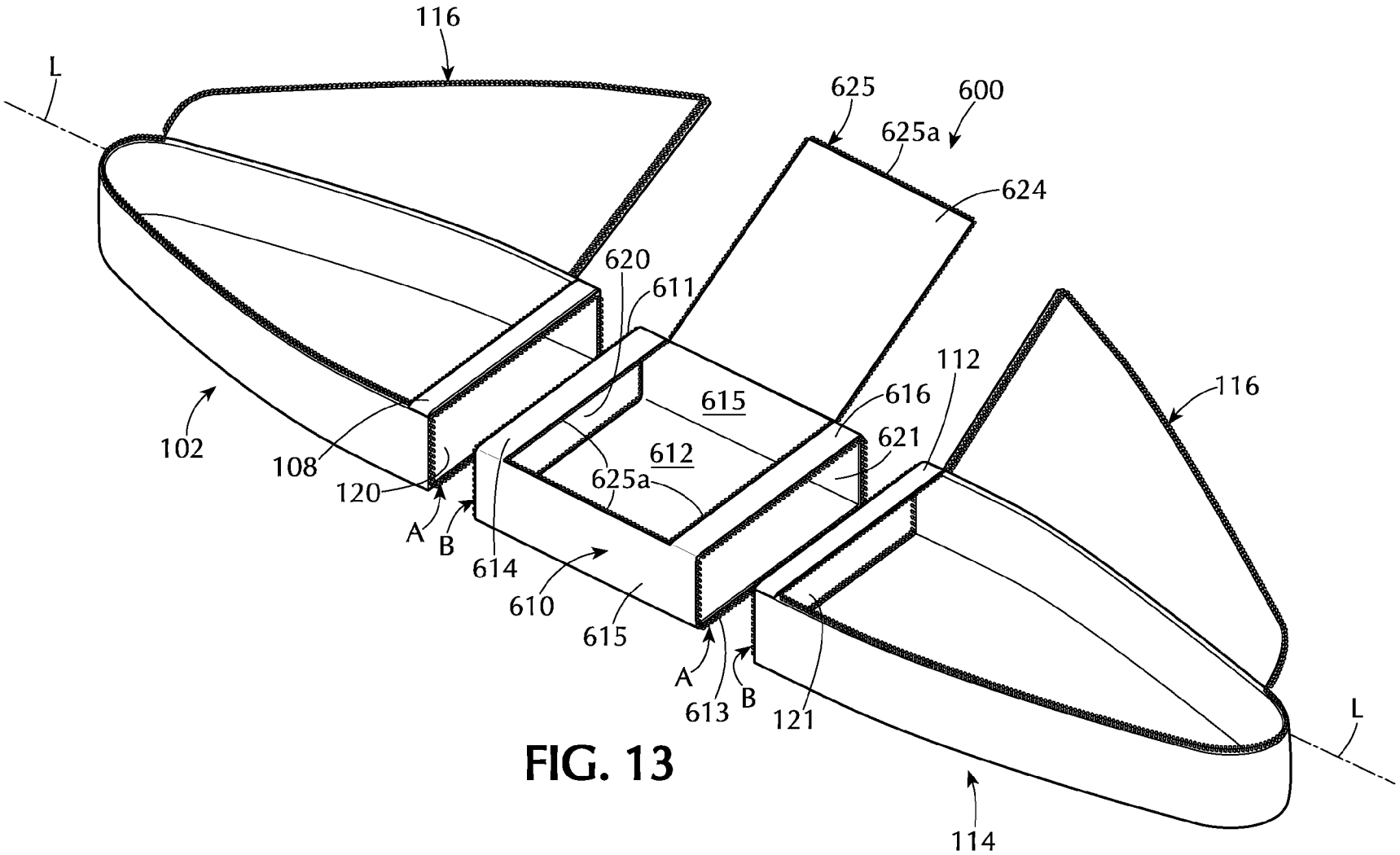
FIG. 13 is an exploded perspective view of still another embodiment of the adjustable carry bag according to the present invention.

FIG. 12 is an exploded perspective view of a modified form of bag 400 shown in FIG. 11. In FIG. 12 the bag is generally designated at 402 and has the same construction as bag 400 in FIG. 11, except that in FIG. 12 the proximal end of each end section 410, 420 is not provided with a cross-member, and the interior of each end section is accessed via an opening 405 formed by a slit (first access opening) provided along top edges of end sections 410, 420 rather than by means of a hinged closure panel. The proximal ends of end sections 410, 420 of bag 402 are also provided with closed perimeter portions from which respective coupling structures A, B extend as described above with reference to FIGS. 3A-3C. Since end sections 410, 420 are not provided with a cross-member (such as the strip 419 in FIG. 11, for example), the closed perimeter portion of each end section is defined partially by the top and bottom portions and the opposite side portions of the end section. In FIG. 12, the formation of the brace across a region of an opening (i.e., providing access into the interior space of bag 402) of bag 402, the uniform and continuous surface or tube section formed around the entire circumference (360 degrees) of bag 402 and corresponding advantages are as described above for FIGS. 5-6. The materials and dimensions for end sections 410, 420, extension section 430 and corresponding coupling structures A, B of bag 402 are as described above for bag 100 in FIGS. 5-6.

FIG. 13 is an exploded perspective view of another exemplary embodiment of an adjustable carry bag, generally designated at 600, according to the present invention. Bag 600 has end sections 102, 114 with respective strips 108, 112, and an extension section 610 configured to be coupled between end sections 102, 114. Other than differences in shape, configuration and/or profile (as well as certain relative dimensional relationships), the construction of sections 102, 114 and closure panels 116 in FIG. 13 is the same as for sections 102, 114 and closure panels 116 of carry bag 100 described above with reference to FIGS. 5-6. As set forth above, the various parts of the carry bags described herein are not limited to the specific shapes, configurations and/or profiles illustrated in the exemplary views. Accordingly, changes to the shapes, configurations and/or profiles shown can be appropriately made without departing from the gist of the invention.

Extension section 610 has a bottom portion 612, opposite side portions 615 extending from bottom portion 612 in spaced-apart relation to one another, and two opposing strips 614, 616 interconnected between side portions 615 so as to define an interior space or pocket with an open top end. A closure flap or panel 624 is hingedly connected along one edge thereof to an edge of one of side portions 615 for providing access into the interior space of extension section 610. Remaining edges of panel 624, the edge of extension section 610 opposite to the edge thereof to which panel 624 is hinged, and inner edges of strips 614, 616 are provided with a closure mechanism 625, such as a zipper with zipper elements 625*a*, for closing and opening panel 624. Each strip 614, 616 has the same construction as described above for strips 108, 112, including the opposite edges of each strip being provided with the zipper elements 625*a* for zipper 625 and zipper elements 613, 611 for coupling structures A, B as described below. Together with bottom portion 612 and side portions 615, strips 614, 616 form respective closed perimeter portions at opposite ends of extension section 610 having substantially the same profile as the respective closed perimeter portions of end sections 102, 114 as described above for the embodiment of FIGS. 1-2. The closed perimeter portions of extension sections 610 define respective openings 620, 621 configured to be substantially aligned with respective openings 120, 121 of end sections 102, 114 when extension section 610 is coupled to end sections 102, 114. In the coupled state of extension section 610 and end sections 102, 114, the aligned openings permit insertion therethrough of one or more boards, for example, that a user wishes to transport in the interior space of bag 600.

Outer edges of strips 614, 616 of extension section 610 are provided with respective coupling structures A, B that extend from and around the entire circumference of the respective closed perimeter and are configured to be releasably coupled to respective coupling structures B, A of end sections 102, 114. Coupling structures A, B of extension section 610 are identical in construction to respective coupling structures A, B of end section sections 102, 114 as described above for FIGS. 5-6. Coupling structures A, B of extension section 610 are configured to be releasably coupled to respective coupling structures B, A of end section 102, 114 as described above with reference to FIGS. 3A-3C to thereby form the complete bag 600 with extension section 610. When extension section 610 is coupled to end sections 102, 114 as set forth above, openings 120, 121 of end sections 102, 114 and openings 620, 621 of extension section 610 are substantially aligned with one another as described above.

In FIG. 13, the formation of a brace across a region of an opening (i.e., providing access into the interior space of bag 600) of bag 600 and the corresponding uniform and continuous surface or tube section formed around the entire circumference (360 degrees) of bag 600 is as described above for FIGS. 5-6. In the embodiment of FIG. 13, however, due to extension 610 having hinged closure 624 providing access into the interior space of extension section 610, two braces are formed across the region of the opening of bag 600 that negatively block direct access from the top of the opening providing access to the interior of bag 600. These two braces include one brace formed by strips 108 and 614 of end section 102 and extension section 610, respectively, and corresponding coupling structures A, B, and another brace formed by strips 112 and 616 of end section 114 and extension section 610, respectively, and corresponding coupling structures A, B. The uniform and continuous surface or tube section around the entire circumference (360 degrees) of bag 600 is formed by the closed perimeter portions of end sections 102, 114, extension section 610 and corresponding closed perimeter portions, and corresponding coupling structures A, B coupling end sections 102, 114 and extension section 610 to one another. Likewise, the advantages of such braces and uniform and continuous surface or tube section are as described above for the embodiment of FIGS. 5-6.

The materials and dimensions for end sections 102, 114, closure panels 116, extension section 610 and corresponding coupling structures A, B of bag 600 are as described above for bag 100 in FIGS. 5-6. Any desired length may be selected for extension section 610 in order to increase the length of bag 600 by an amount suitable to accommodate one or more boards of different lengths that a user wishes to transport. For example, extension section 610 may be about 24" in length so that when coupled to end section 102, 114, the resulting bag 600 may have an overall length of about 8'8" which will accommodate various types of board sizes, including all fun boards and smaller long boards. However, it will be appreciated that extension section 610 may have a length that is greater or less than about 24" without departing from the spirit and scope of the present invention.

By the foregoing construction, it will be appreciated that the zippered panel 624 of extension section 610 allows enhanced access to a central interior portion of bag 600, as compared to the extension sections described above with reference to FIGS. 5-11. This enhanced access to the central portion of bag 600 further facilitates insertion and accommodation of the boards and other accessories into the interior space of the bag, as well as removal thereof from the interior space of the bag.

Figure 14:
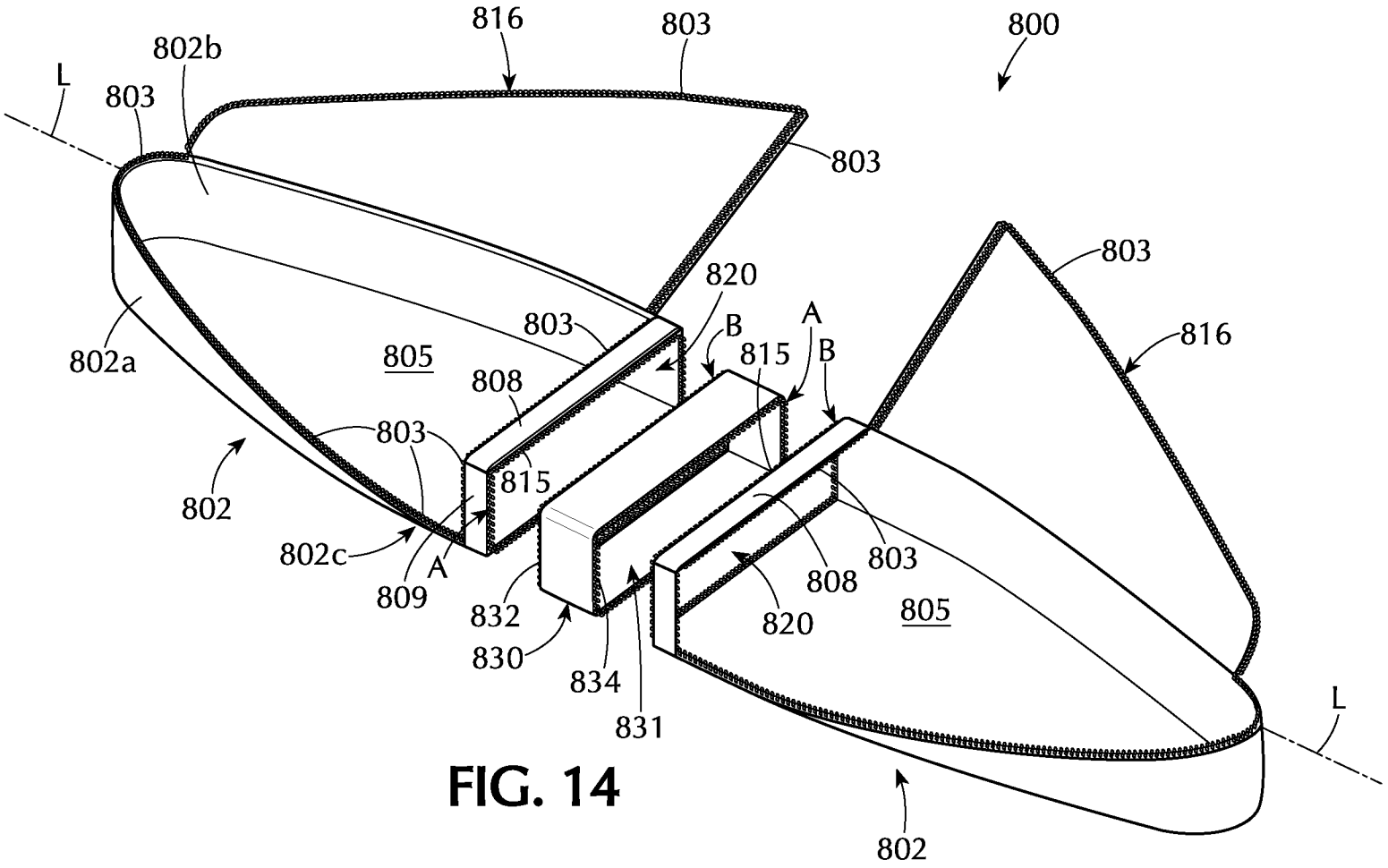
FIG. 14 is an exploded perspective view of still another embodiment of the adjustable carry bag according to the present invention.

FIG. 14 is an exploded perspective view of another exemplary embodiment of an adjustable carry bag, generally designated at 800, according to the present invention. The bag 800 has two end sections 802 of identical construction and an extension section 830 that is releasably coupled between end sections 802. Bag 800 is shown with end sections 802 and extension section 830 in an uncoupled state and with closure panels 816 in an open position. The length L of bag 800 is adjusted (i.e., increased) by adding (i.e., coupling) extension section 830 between end sections 802. Extension section 830 is similar in construction to extension section 160 described above with reference to FIG. 6. Bag 800 is similar to bag 100 described above with reference to FIGS. 5-6 except for the construction of end sections 802 and panels 816 as further described below.

Each end section 802 is formed of side panels 802*a*, 802*b*, a bottom panel 805 extending from side panels 802*a*, 802*b*, and two support structures in the form of strip-shaped cross-members 808, 809 ("strips") at the proximal end of the end section 802, all forming a top opening (first access opening) providing access into an interior space (pocket) of end section 802 defining an interior volume large enough to accommodate at least a portion of one or more surfboards S (e.g., of identical or different size) in a manner as shown in FIG. 6. Similarly to FIG. 5, each closure panel 816 is hingedly connected to an upper edge of side portion 802*b*.

Each section 802 differs from the end sections of the bag 100 in FIGS. 5-6 in that side panel 802*a* of end section 802 tapers downwardly from the distal end to the proximal end of end section 802 and terminates at a point of bottom panel 805 so as to expose an edge 802*c* of bottom panel 805 that extends from the termination of side panel 802*a* to strip 809. By this construction, side panel 802*a* forms a cut away (a portion of side panel 802*a* is removed as compared to side panel 102*a* of bag 100 in FIG. 1, for example) that enhances access into the interior space of end section 802, such as during accommodation and removal of surfboards into and from the interior space of end section 802.

Each closure panel 816 has the same configuration as closure panel 116 of bag 100 in FIG. 5, except that the pertinent dimension and configuration of the closure panel 816 are proportionally adjusted (i.e., the size is increased) to compensate for the cut away side panel 802*a* (i.e., the removed portion of side panel 802*a*) in order to allow zipper elements 803 (as further described below) of closure panel 816 and the corresponding end section 802 to be engaged with one another. This allows the top opening and the cut away of each end section 802 to be completely covered by closure panel 816 when closed while zipper elements 803 of closure panel 816 and end section 802 are engaged with one another.

As described above, each end section 802 is provided with two strips 808, 809. The strip 809 is attached at one end to the bottom panel 805 and extends upwardly therefrom in a direction generally perpendicular to the length direction L of end section 802. The strip 808 has one end attached to the other end of strip 809 and another end attached to side panel 802*b* in the width direction of end section 802. By this construction, strip 809 extends and is connected between bottom panel 805 and strip 808, and strip 808 extends and is connected between strip 809 and side panel 802*b*.

For each end section 802, edges of closure panel 816 and end section 802, except for the edges thereof hingedly connected together, and edges of strips 808, 809 are provided with a closure mechanism (e.g., a zipper) for opening and closing closure panel 816. For example, in this exemplary embodiment the closure mechanism comprises a zipper, as described above for bag 100 of FIGS. 5-6, with peripheral edges of closure panel 816, upper edge of tapered side panel 802*a*, exposed edge 802*c* of bottom panel 805, and inner edges of strips 808, 809 being provided with zipper elements 803.

In the exemplary embodiment of FIG. 14, strips 808, 809 and extension section 830 have a construction similar to that of strips 108, 112 and extension section 160, respectively, described above with reference to FIGS. 5-6. End sections 802 are provided with respective coupling structures A, B and extension section 830 is provided with corresponding coupling structures B, A, as described above for bag 100 in FIGS. 5-6 and with reference to FIGS. 3A-3C. For clarity of illustration only, in this exemplary embodiment coupling structures A, B for end sections 802 are denoted generally by zipper elements 815 which are provided on outer edges of side and bottom panels 802*b*, 805 and outer edges of strips 808, 809. Likewise, in extension section 830, coupling structures B, A are denoted generally by respective zipper elements 832, 834. The materials and dimensions for end sections 802, closure panels 816, extension section 830 and corresponding coupling structures A, B of bag 800 are as described above for bag 100 in FIGS. 5-6, except as denoted above for the proportional adjustment to the dimension and configuration of panels 816 to compensate for the cut away side panels 802*a*.

Similar to end sections 102, 114 described above with reference to FIGS. 5-6, proximal ends of end sections 802 of bag 800 in FIG. 14 are provided with respective closed perimeter portions from which respective coupling structures A, B extend as described above with reference to FIGS. 3A-3C. For each end section 802, the closed perimeter portion is defined partially by each of strips 808, 809 and by bottom panel 805 and side panel 802*b* of the end section. The closed perimeter portion of each end section 802 defines an opening 820 (second access opening) also providing access into the interior space (pocket) of the end section as described above for openings 120, 121 of FIGS. 1-2. Extension section 830 has an opening 831 that is configured to be substantially aligned with openings 820 of end sections 802 when extension section 830 is coupled to end sections 802. In the coupled state of extension section 830 and end sections 802, aligned openings 820, 831 permit insertion therethrough of one or more boards, for example, that a user wishes to transport in the interior space of bag 800.

In FIG. 14, the formation of the brace across a region of an opening (i.e., providing access into the interior space of bag 800) of bag 800, the uniform and continuous surface or tube section formed around the entire circumference (360 degrees) of bag 800 and corresponding advantages are as described above for FIGS. 5-6.

It will be appreciated that while the end sections of the bags in each of the foregoing exemplary embodiments of the invention are depicted in the drawings as being substantially identical in construction, it is understood that certain modifications can be made to the end sections such that they are only generally or substantially identical, or not identical at all, without departing from the spirit and scope of the invention.

The exemplary embodiments of the bags having the various modified forms of the end sections described above with reference to FIGS. 9-14 are illustrated with an extension section that is releasably coupled to the end sections via coupling structures A, B. It will be appreciated by those skilled in the art, however, that the bag in each of the embodiments shown FIGS. 9-14 may be assembled by releasably coupling together the end sections directly together without the use of an extension section, such as described above with reference to the embodiment of FIGS. 1-2. Furthermore, although each of the bags in FIGS. 9-14 is depicted with only one extension section interposed between the end sections, two or more extension sections may be releasably coupled between the end sections, such as described above with reference to FIGS. 7-8.

Although not shown in the drawings, it will be appreciated that any conventionally known wheel adapter mechanisms (wheel attachments) may be mounted or built-in to any one of the adjustable carry bags 100, 200, 400, 402, 600, 700 and 800 described above with reference to FIGS. 1-14. Such conventional wheel attachments may be releasably mounted or built-in to either the nose or tail section of the bag for facilitating transportation of the bag. By the wheel attachment being releasably mounted to the bag, the bag can be used without the wheel attachment so that it is lighter and more easily carried, or with the wheel attachment so that it can be easily transported when the bag is loaded with more boards and other contents (e.g., gear).

It will be appreciated from the preferred embodiments described above that the present invention provides a carry bag that is adjustable in the length direction thereof to accommodate one or multiple boards of multiple lengths securely and in a compact manner. Particularly during transport, the adjustable carry bag according to the present invention is able to effectively and sufficiently protect the board(s) from impact, shock, and scratches which would ordinarily result in substantial damage to the board(s). The carry bag is also adjustable to accommodate boards of various sizes securely. Furthermore, the adjustable carry bag is able to carry accessories, or other items, securely while keeping them dry and clean. The adjustable carry bag according to the present invention is cost effective and easy to carry.

Moreover, due to its cost effectiveness and ability to accommodate multiple boards and adjust to optimal length, while providing sufficient protection to the boards, the adjustable carry bag according to the present invention exhibits significant advantages over conventional carry bags described herein. An additional important advantage over conventional carry bags is that distributors and sellers of the adjustable carry bag of the present invention would no longer have to store multiple bags to accommodate all the different board length requirements, but could instead stock one of the adjustable carry bags of the present invention that would suit all board travel, resulting in a maximized use of floor space as well as an increase in sales.

Additionally, when most of the volume of the adjustable carry bag according to the present invention is defined by flexible high density foam throughout the bag, the bag is advantageously light in weight. The length of the bag can then be sized as needed by coupling between the end sections one or more extension sections according to the present invention as disclosed herein. The extension sections further permit the bag to be extended to any length in 6" increments, for example, allowing the bag to always be the right size. The adjustable bag according to the present invention also competes effectively on price because it allows a user to purchase only a bag with the needed length, adding extension sections when necessary which, in many cases, replaces the need for two or more bags.

Another unique feature of the adjustable carry bag according to the present invention is that the bag includes two uniform end sections that could be securely and readily coupled or fastened together to form the bag while encircling the boards in the middle of the bag. This is made possible by the adjustable bag according to the described exemplary embodiments of the invention which provides a cross-member in the form of a brace across a region of an opening (i.e., providing access into the interior space of the bag) of the bag that negatively blocks direct access from the top of the opening, while the closed peripheral portions of the end sections and the coupling structures extending therefrom create a uniform and continuous surface or tube section around the entire circumference (360 degrees) of the bag. This novel construction of the adjustable carry bag according to the present invention facilitates provision of a strong connection between the end sections, particularly for carry bags made of soft, flexible materials, as well as serves to enhance the structural integrity and protective capability of the bag by providing 360 degrees of connection across the end sections and a continuous seal on all closure panels. Additionally, the uniform and continuous surface or tube section around the entire circumference (360 degrees) of the bag advantageously allows a single zipper to fully attach the end sections together into the completed bag.

The previous description of the disclosure is provided to enable any person skilled in the art to make or use the present invention. It will be appreciated that numerous changes and modifications will be readily apparent to those skilled in the art, and the generic principles defined herein may be applied to other variations without departing from true spirit and scope of the present invention. Thus, the disclosure is not intended to be limited to the examples and designs described herein but are to be accorded the widest scope consistent with the principles and novel features disclosed herein.

What is claimed is:

1. An adjustable carry bag for accommodating and carrying at least one sport board, the adjustable carry bag comprising:

a pair of end sections configured for releasable connection together at connecting ends thereof to form an interior space of the adjustable carry bag for accommodating therein at least one sport board, each of the end sections having a first access opening providing access into the interior space and a closed perimeter portion at the connecting end thereof defining a second access opening providing access into the interior space different from the access provided by the first access opening, the first access opening being configured in an open state thereof to provide access into the interior space for accommodating therein the least one sport board and being configured in a closed state thereof so that the bag completely encloses and securely holds therein the at least one sport board when the end sections are releasably connected together; and a coupling structure extending from the closed perimeter portion of each of the end sections for releasably coupling the end sections together so that the second access openings are generally aligned with one another and the closed perimeter portions and the coupling structures of the end sections encircle a preselected region of the interior space of the adjustable carry bag in both the open and closed states of the first access opening;

wherein each of the end sections comprises a bottom panel, two side panels extending from the bottom panel, and a cross-member extending between and connected to top portions of the two side panels, the closed perimeter portion being defined by the cross-member, the bottom panel and the two side panels.

2. The adjustable carry bag according to claim 1, wherein the closed perimeter portions and coupling structures of the end sections completely encircle by 360 degrees the preselected region of the interior space of the adjustable carry bag in both the open and closed states of the first access opening when the end sections are releasably coupled together.

3. The adjustable carry bag according to claim 2, wherein the preselected region of the interior space corresponds to a generally central region of the adjustable carry bag along a length direction thereof.

4. The adjustable carry bag according to claim 1, further comprising at least one extension section configured for releasable connection between the connecting ends of the end sections to increase the length of the adjustable carry bag, the at least one extension section having at opposite ends thereof respective closed perimeter portions defining an opening and having coupling structures extending from the respective closed perimeter portions, the coupling structures of the at least one extension section being configured for releasable connection to the coupling structures of the end sections to releasably couple together the end sections and the at least one extension section to increase the length of the adjustable carry bag with the opening of the at least one extension section being disposed in substantial alignment with the second access openings of the end sections.

5. The adjustable carry bag according to claim 4, wherein the closed perimeter portions and coupling structures of the end sections and the at least one extension section completely encircle by 360 degrees the preselected region of the interior space of the adjustable carry bag in both the open and closed states of the first access opening when the end sections and the at least one extension section are releasably coupled together.

6. The adjustable carry bag according to claim 5, wherein the at least one extension section comprises a plurality of extension sections.

7. The adjustable carry bag according to claim 1, wherein each of the end sections further comprises a top panel, the two side panels extending between the top and bottom panels to form the portion of the interior space; and wherein for each of the end sections, the first access opening is formed by and between confronting edges of the top panel and one of the side panels, the confronting edges being provided with connecting elements configured for selective engagement with and disengagement from one another to place the first access opening in the closed state and open state, respectively.

8. The adjustable carry bag according to claim 1, wherein when the end sections are releasably coupled together, the cross-members of the end sections form a brace across the preselected region of the interior space that negatively blocks direct access into the interior space while the closed perimeter portions and the coupling structures encircle the preselected region so as to create a uniform and continuous surface around the entire circumference of the bag.

9. The adjustable carry bag according to claim 1, further comprising for each of the end sections a closure panel having a plurality of edges; and wherein for each of the end sections, the closure panel is connected along one of the edges thereof to an edge of one of the side panels, and remaining edges of the closure panel, an edge of the other of the side panels and an edge of the cross-member are provided with connecting elements configured for selective engagement with and disengagement from one another to place the first access opening in the closed state and open state, respectively.

10. The adjustable carry bag according to claim 1, further comprising for each of the end sections a closure panel having a plurality of edges; and wherein for each of the end sections, the closure panel is connected along one edge of the cross-member, and remaining edges of the closure panel and edges of the two side panels are provided with connecting elements configured for selective engagement with and disengagement from one another to place the first access opening in the closed state and open state, respectively.

11. The adjustable carry bag according to claim 1, further comprising at least one extension section configured for releasable connection between the connecting ends of the end sections to increase the length of the adjustable carry bag, the extension section having a bottom portion, opposite side portions extending from the bottom portion in spaced-apart relation to one another to define an interior space of the extension section, and a closure panel connected along one edge thereof to an edge of one of the side portions for providing access into the interior space of the extension section, the side portions of the extension section forming respective closed perimeter portions defining an opening, and including coupling structures extending from the respective closed perimeter portions and configured for releasable connection to the coupling structures of the end sections to releasably couple together the end sections and the extension section to increase the length of the bag with the opening of the extension section being disposed in substantial alignment with the access openings of the end sections.

12. The adjustable carry bag according to claim 1, wherein the cross-member comprises a first cross-member; and further comprising a second cross-member connected at one end thereof to the bottom panel and connected at another end thereof to an end of the first cross-member, the closed perimeter portion being defined by the bottom panel, the side panels, and the first and second cross-members.

13. The adjustable carry bag according to claim 12, wherein for each of the end sections: one of the side panels tapers downwardly from a distal end of the end section to a proximal end of the end section corresponding to the connecting end, the one side panel terminating at a point of the bottom panel so as to expose an edge of the bottom panel that extends from the termination of the one side panel to the second cross-member, thereby forming a cutaway providing access into the portion of the interior space from a side of the end section.

14. The adjustable carry bag according to claim 13, wherein each of the end sections includes a closure panel having a plurality of edges, the closure panel being connected along one of the edges thereof to an edge of the other of the side panels; wherein remaining edges of the closure panel, an edge of the one side panel, an edge of each of the first and second cross-members and the exposed edge of the bottom panel are provided with connecting elements configured for selective engagement with and disengagement from one another to place the first access opening in the closed state and open state, respectively.

15. The adjustable carry bag according to claim 1, further comprising at least one extension section configured for releasable connection between the connecting ends of the end sections to increase the length of the enclosure, the at least one extension section having at opposite ends thereof respective closed perimeter portions defining an opening and having coupling structures extending from the respective closed perimeter portions, the coupling structures of the at least one extension section being configured for releasable connection to the coupling structures extending from the closed perimeter portions of the end sections to releasably couple together the end sections and the at least one extension section to increase the length of the enclosure with the opening of the at least one extension section being disposed in substantial alignment with the second access openings of the end sections.

16. An adjustable carry bag for accommodating and carrying at least one sport board, the adjustable carry bag comprising:

a pair of end sections configured for releasable connection together at connecting ends thereof to form an enclosure having first access openings configured in an open state thereof to provide access into an interior space of the enclosure for accommodating therein at least one sport board and configured in a closed state thereof so that the bag completely encloses and securely holds therein the at least one sport board when the end sections are releasably connected together, each of the end sections having a bottom panel, a pair of side panels extending from the bottom panel, a cross-member extending between and connected to top portions of the side panels at the connecting end, and a closed perimeter portion at the connecting end defined by the cross-member, the side panels and the bottom panel and defining second access openings providing access into the interior space different from the access provided by the first access openings;

a pair of closure panels connected to the respective end sections for releasably closing the first access openings; and a coupling structure extending from the closed perimeter portion of each of the end sections for releasably coupling the end sections together so that the second access openings are generally aligned with one another, the closed perimeter portions and coupling structures of the end sections completely encircling by 360 degrees a preselected region of the interior space of the bag in both the open and closed states of the first access openings when the end sections are releasably connected together.

* * * * *